US008899250B1

(12) United States Patent
Tung

(10) Patent No.: US 8,899,250 B1
(45) Date of Patent: Dec. 2, 2014

(54) TILTABLE SUNSHADE

(71) Applicant: Benson Tung, Kaohsiung (TW)

(72) Inventor: Benson Tung, Kaohsiung (TW)

( * ) Notice: Subject to any disclaimer, the term of this patent is extended or adjusted under 35 U.S.C. 154(b) by 0 days.

(21) Appl. No.: 13/967,450

(22) Filed: Aug. 15, 2013

(51) Int. Cl.
*A45B 17/00* (2006.01)
*A45B 25/14* (2006.01)

(52) U.S. Cl.
CPC ..... *A45B 17/00* (2013.01)
USPC ..... 135/20.1; 135/20.3

(58) Field of Classification Search
USPC ..... 135/20.1, 20.3, 98
See application file for complete search history.

(56) References Cited

U.S. PATENT DOCUMENTS

| | | | | |
|---|---|---|---|---|
| 3,311,119 | A * | 3/1967 | Pearlstine | 135/20.3 |
| 4,878,509 | A | 11/1989 | Tung | 135/20 |
| 6,543,464 | B1 * | 4/2003 | Grady, II | 135/22 |
| 7,406,976 | B1 * | 8/2008 | Chan et al. | 135/20.3 |
| 7,481,232 | B2 * | 1/2009 | Apple | 135/22 |
| 7,562,666 | B2 * | 7/2009 | Chan | 135/20.3 |
| 7,814,920 | B2 | 10/2010 | Lenahan | 135/20.1 |
| 7,909,049 | B2 * | 3/2011 | Yang et al. | 135/20.3 |
| 8,522,804 | B1 * | 9/2013 | Tung | 135/20.1 |
| 8,534,304 | B1 * | 9/2013 | Tung | 135/20.1 |
| 8,763,620 | B1 * | 7/2014 | Tung | 135/20.1 |
| 2006/0151019 | A1 * | 7/2006 | Lo | 135/20.3 |

* cited by examiner

*Primary Examiner* — Noah Chandler Hawk
(74) *Attorney, Agent, or Firm* — Alan D. Kamrath; Kamrath IP Lawfirm, P.A.

(57) ABSTRACT

A tiltable sunshade (12) includes a pole (111) rotatably receiving a rod (573) around which a helical spring (579) is mounted. The helical spring (579) can be rotated by operating a handle (213) to cause movement of a follower (599) in the pole (111) between a folded position and an unfolded position and an optional tilted position to fold ribs (451), unfold the ribs (451), and optionally tilt the ribs (451), respectively. When the follower (599) is in the unfolded position or the tilted position, if a canopy (475), the ribs (475), or stretchers (451) of the tiltable sunshade (12) is subjected to an external force causing the runner (297) to move along the longitudinal axis of the pole (111), the helical spring (579) is compressed by the follower (599) and undergoes elastic deformation, providing a buffering effect to the external force.

5 Claims, 19 Drawing Sheets

TILTABLE SUNSHADE

BACKGROUND OF THE INVENTION

The present invention relates to a sunshade and, more particularly, to a sunshade that can be tilted according to the position of the sun.

A type of outdoor sunshade includes a pole located on the ground and a plurality of ribs each having an end pivotably connected to a top end of the pole. A runner is slideably mounted to the pole. A plurality of stretchers is pivotably connected between the runner and the ribs. A canopy is provided on the ribs. A handle is fixed on a shaft rotatably mounted to the pole. An end of a cable is fixed to a portion of the shaft inside the pole, with the other end of the cable extending out of the pole and fixed to the runner. Rotation of the handle causes the canopy to move from a folded state to an unfolded state. Further rotation of the handle causes the canopy to tilt. Thus, a user can adjust the tilting angle of the canopy according to the position of the sun. However, the exposed portion of the cable is liable to break by an external force or an excessive pulling force. Furthermore, when the sunshade is under a strong wind load, the force acting on the canopy is imparted to the handle, leading to loosening of the cable and bounce of the tilted canopy. As a result, the user standing below the canopy may be injured.

Thus, a need exists for a tiltable sunshade providing reliable, safe operation.

BRIEF SUMMARY OF THE INVENTION

The present invention solves this need and other problems in the field of safe use of sunshades by providing a sunshade including a pole having upper and lower ends spaced from each other along a longitudinal axis of the pole.

In a first aspect, a tiltable sunshade includes a pole having upper and lower ends spaced from each other along a longitudinal axis of the pole. The pole further includes an outer periphery and an inner periphery spaced from the outer periphery in a radial direction perpendicular to the longitudinal axis of the pole. The inner periphery of the pole defines a longitudinal hole. The lower end of the pole is adapted to be rotatably coupled to a base. A rod is rotatably received in the longitudinal hole of the pole. A helical spring is mounted around the rod and includes first and second fixing ends fixed to the rod. The rod and the helical spring are jointly rotatable about the longitudinal axis of the pole. A follower is received in the longitudinal hole of the pole and threadedly engaged with the helical spring. Rotation of the helical spring about the longitudinal axis of the pole causes movement of the follower along the longitudinal axis of the pole between a folded position and an unfolded position. A runner is slideably mounted around the pole and coupled to the follower. The runner and the follower are jointly moveable along the longitudinal axis of the pole. Each of a plurality of stretchers has a first end pivotably connected to the runner and a second end spaced from the first end along a longitudinal axis of the stretcher. The plurality of stretchers is jointly movable with the runner and the follower. A hub is mounted to the upper end of the pole. Each of a plurality of ribs includes a connecting end pivotably connected to the hub. The second end of each of the plurality of stretchers is pivotably connected to one of the plurality of ribs. A canopy is adapted to be mounted to the plurality of ribs.

Rotation of the helical spring causes movement of the follower between the folded position and the unfolded position, and the runner moves together with the follower to open or collapse the canopy. When the follower is in the unfolded position, if the canopy, the plurality of ribs, or the plurality of stretchers is subjected to an external force causing the runner to move along longitudinal axis of the pole, the helical spring is compressed by the follower and undergoes elastic deformation, providing a buffering effect to the external force.

In a second aspect, a tiltable sunshade includes a pole having upper and lower ends spaced from each other along a longitudinal axis of the pole. The pole further includes an outer periphery and an inner periphery spaced from the outer periphery in a radial direction perpendicular to the longitudinal axis of the pole. The inner periphery of the pole defines a longitudinal hole. The lower end of the pole is adapted to be rotatably coupled to a base. A rod is rotatably received in the longitudinal hole of the pole. A helical spring is mounted around the rod and includes first and second fixing ends fixed to the rod. The helical spring further includes a small pitch portion at the second fixing end and a large pitch portion extending from a lower end of the small pitch portion to the first fixing end. The large pitch portion of the helical spring has a pitch larger than a pitch of the small pitch portion. The rod and the helical spring are jointly rotatable about the longitudinal axis of the pole. A follower is received in the longitudinal hole of the pole and threadedly engaged with the helical spring. Rotation of the helical spring about the longitudinal axis of the pole causes movement of the follower along the longitudinal axis of the pole between a folded position, an unfolded position, and a tilted position. A runner is slideably mounted around the pole and coupled to the follower. The runner and the follower are jointly moveable along the longitudinal axis of the pole. Each of a plurality of stretchers has a first end pivotably connected to the runner and a second end spaced from the first end along a longitudinal axis of the stretcher. The plurality of stretchers is jointly movable with the runner and the follower. A fixing member is fixed to the upper end of the pole. A pivotable member is pivotably connected to the fixing member. A hub is mounted to the pivotable member. The hub and the pivotable member are jointly pivotable between a first position and a second position. Each of a plurality of ribs includes a connecting end pivotably connected to the hub. The second end of each of the plurality of stretchers is pivotably connected to one of the plurality of ribs. A canopy is adapted to be mounted to the plurality of ribs.

When the follower moves between the folded position and the unfolded position through rotation of the helical spring, the follower is pushed by the large pitch portion to move at a first speed, causing movement of the runner to open or collapse the canopy.

When the follower moves from the unfolded position to the tilted position through rotation of the helical spring, the follower is pushed by the small pitch portion to move at a second speed smaller than the first speed, the pivotal member is actuated by the follower to pivot from the first position to the second position in which the plurality of ribs and the plurality of stretchers are tilted.

When the follower moves from the tilted position to the unfolded position through rotation of the helical spring, the follower is pushed by the small pitch portion to move at the second speed, the pivotal member is actuated by the follower to pivot from the second position to the first position in which the plurality of ribs and the plurality of stretchers are not tilted.

When the follower is in the unfolded position or the tilted position, if the canopy, the plurality of ribs, or the plurality of stretchers is subjected to an external force causing the runner to move along the longitudinal axis of the pole, the helical spring is compressed by the follower and undergoes elastic deformation, providing a buffering effect to the external force.

Preferably, a first hole extends from the outer periphery through the inner periphery of the pole. The rod includes a lower end and an upper end. The first fixing end of the helical spring is fixed to the rod at a location adjacent to the lower end of the rod. The second fixing end of the helical spring is fixed to the rod at a location adjacent to the upper end of the rod. The fixing member includes a sliding groove and a pin hole. The pivotable member includes a track and a pivot hole. A first transmission member is rotatably mounted in the first hole. The first transmission member includes a toothed portion located in the longitudinal hole of the pole. A handle is located outside of the pole and fixed to the first transmission member. The handle and the first transmission member are jointly rotatable about a rotating axis perpendicular to the longitudinal axis of the pole. A support is fixed in the longitudinal hole of the pole and located between the first transmission member and the helical spring along the longitudinal axis of the pole. A second transmission member is received in the longitudinal hole of the pole. The second transmission member includes a shaft rotatably supported by the support. The second transmission member further includes a toothed portion meshed with the toothed portion of the first transmission member. The shaft of the second transmission member is coupled to the lower end of the rod. The second transmission member, the rod, and the helical spring jointly rotate about the longitudinal axis of the pole when the first transmission member rotates about the rotating axis. A pin extends through the pivot hole of the pivotable member and the pin hole of the fixing member. The pivotable member is pivotable relative to the fixing member about a pivot axis defined by the pin between the first position and the second position. A longitudinal axis of the pivotable member in the first position is coaxial to the longitudinal axis of the pole. The longitudinal axis of the pivotable member in the second position is at an obtuse angle to the longitudinal axis of the pole. An actuation rod slideably extends through the sliding groove of the fixing member and is slideably received in the track of the pivotable member. A link includes a first connection end connected to the actuation rod and a second connection end. A connection member includes a first end pivotably connected to the second connection end of the link and a second end. A positioning pin extends through the connection member in a radial direction perpendicular to the longitudinal axis of the pole. The positioning pin has two ends located outside of the connection member. A spring is mounted around the connection member and includes a first end abutting the fixing member and a second end abutting the two ends of the positioning pin. A first spacing between the follower in the folded position and the second transmission member along the longitudinal axis of the pole is smaller than a second spacing between the follower in the unfolded position and the second transmission member along the longitudinal axis of the pole. The second spacing is smaller than a third spacing between the follower in the tilted position and the second transmission member along the longitudinal axis of the pole.

When the follower moves from the unfolded position to the tilted position through rotation of the helical spring, the follower pushes the connection member to move along the longitudinal axis of the pole, causing compression of the spring by the positioning pin. The connection member actuates the link to move the actuation rod along the sliding groove of the fixing member. The actuation rod presses against a wall of the track of the pivotable member to pivot the pivotable member from the first position to the second position. The hub, the plurality of ribs, and the plurality of stretchers pivot together with the pivotable member. The hub and the plurality of ribs are tilted relative to the pole.

When the follower is in the unfolded position or the tilted position, if the canopy, the plurality of ribs, or the plurality of stretchers is subjected to the external force causing the pivotal member to pivot from the first position towards the second position, the helical spring is compressed by the follower and undergoes elastic deformation to provide a buffering effect to the external force.

When the follower moves from the tilted position to the unfolded position through rotation of the helical spring, the spring presses against the positioning pin to cause the connection member and the link to move jointly along the longitudinal axis of the pole. The actuation rod presses against the wall of the track of the pivotable member to pivot the pivotable member from the second position to the first position. The hub and the plurality of ribs are not tilted relative to the pole when the pivotable member is in the first position.

Preferably, a connecting member is mounted between the rod and the second transmission member and includes a first end and a second end. A first receptacle is defined in an end face of the first end of the connecting member. A second receptacle is defined in an end face of the second end of the connecting member. The lower end of the rod is fixed in the second receptacle. The shaft is fixed in the first receptacle. The second transmission member, the connecting member, and the helical spring are not movable along the longitudinal axis of the pole.

Preferably, the pitch of the large pitch portion of the helical spring is between 7 mm and 12 mm, and the pitch of the small pitch portion of the helical spring is between 2 mm and 4 mm.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figure 1:
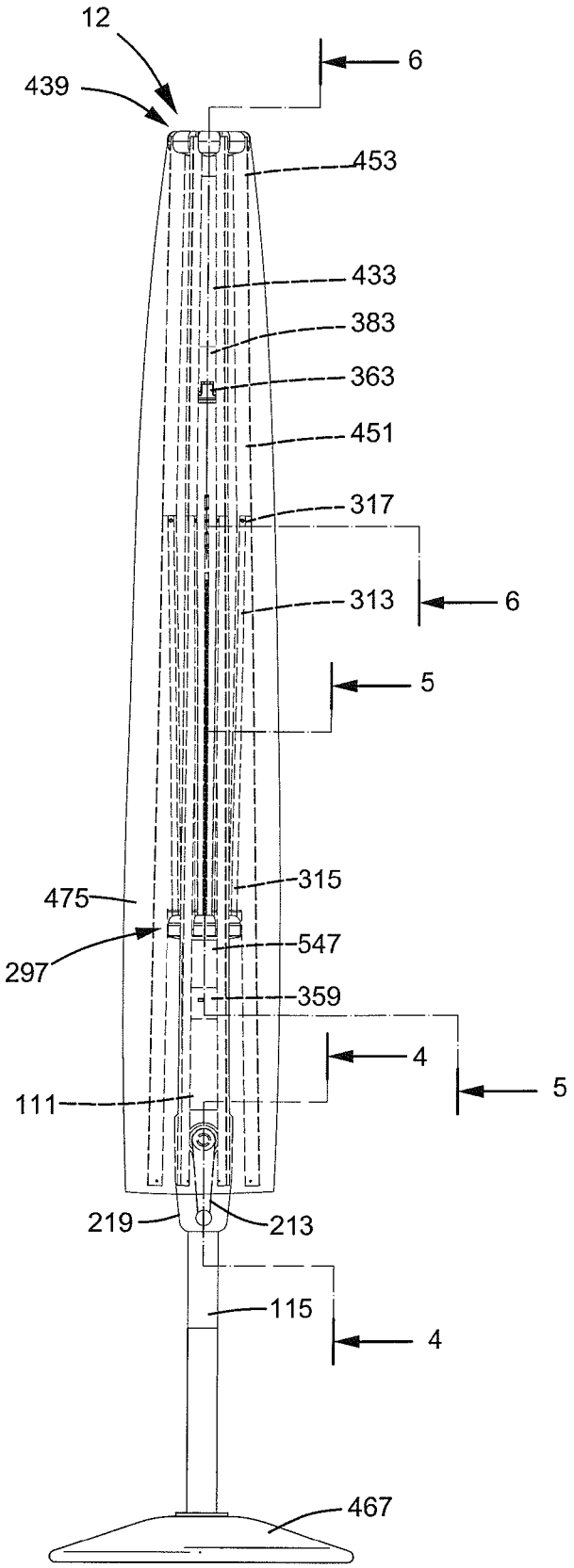
FIG. 1 shows a side elevational view of a tiltable sunshade according to the present invention, with the sunshade in a folded state.
Figure 2:
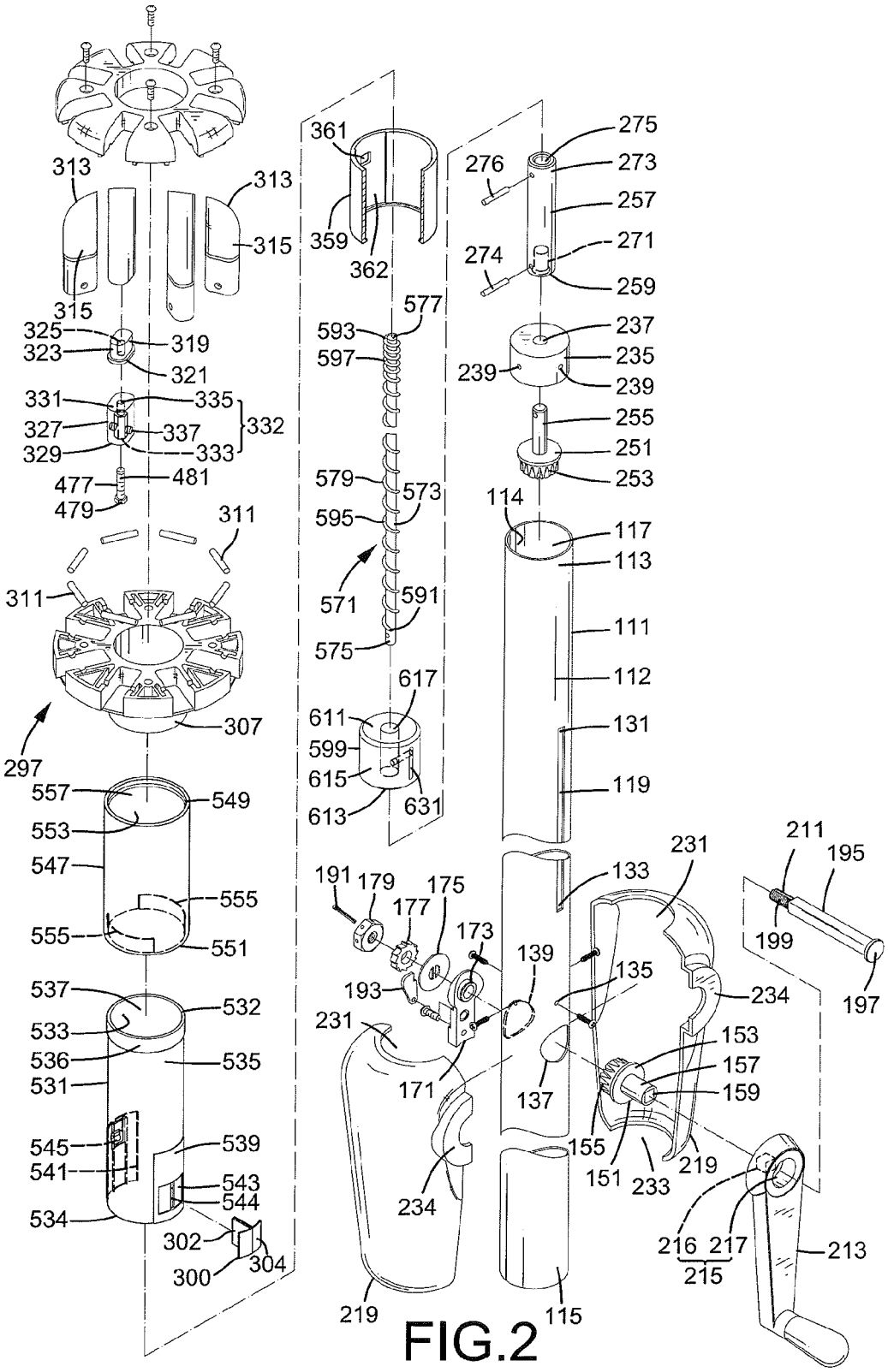
FIG. 2 shows a partial, exploded, perspective view of the tiltable sunshade of FIG. 1.
Figure 2A:
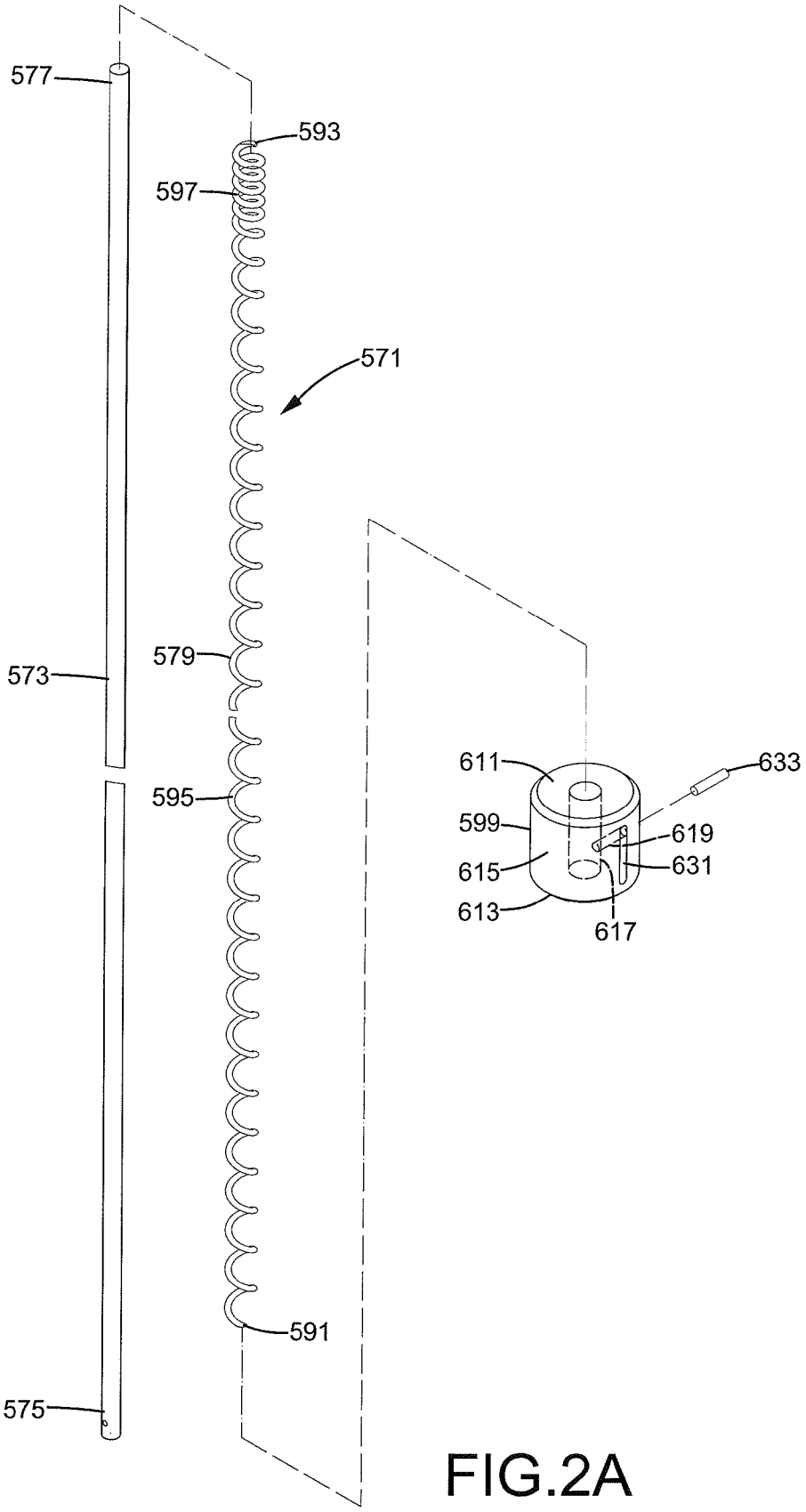
FIG. 2A shows an exploded, perspective view of a rod assembly of the tiltable sunshade of FIG. 1.
Figure 3:
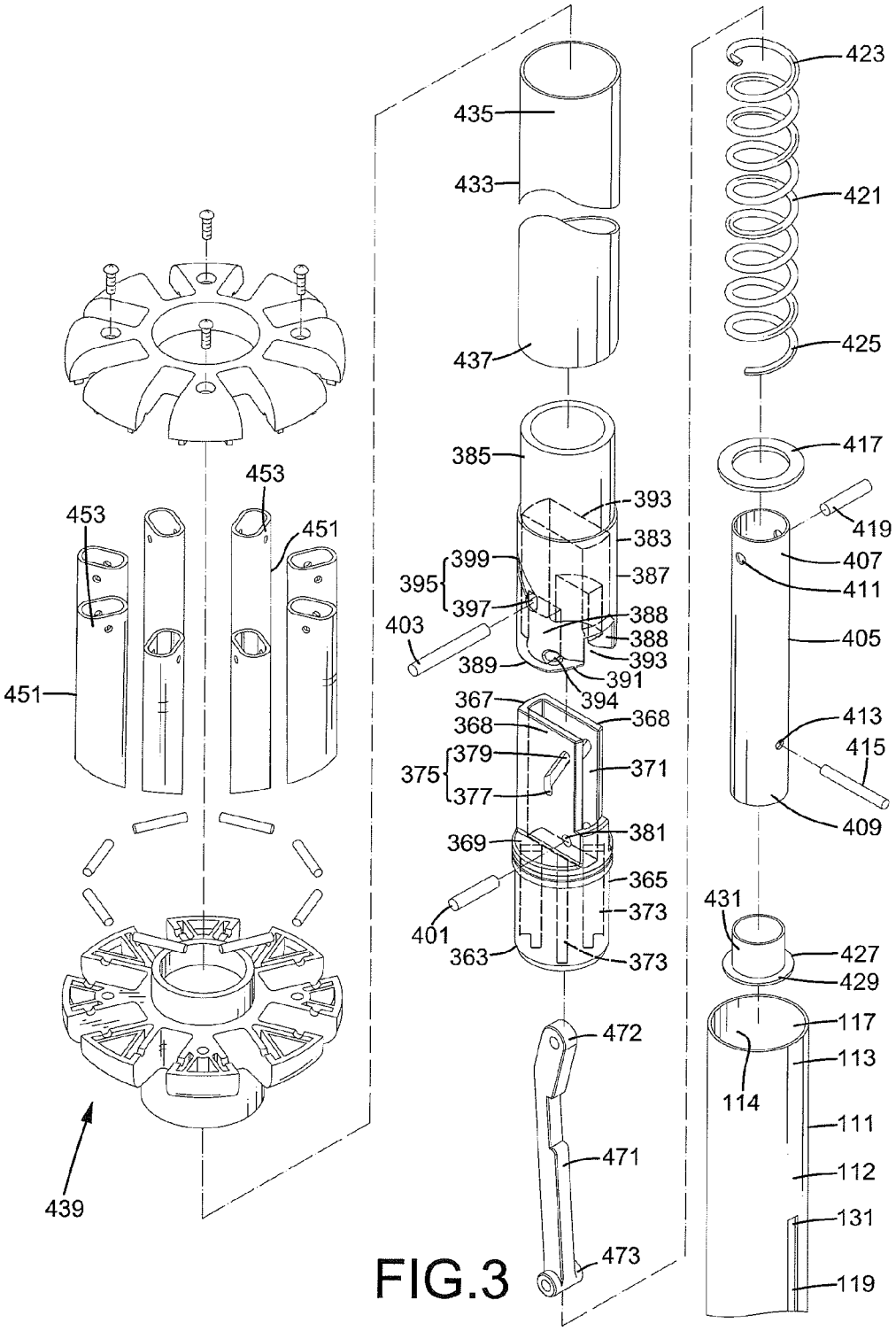
FIG. 3 shows another partial, exploded perspective view of the tiltable sunshade of FIG. 1.

All figures are drawn for ease of explanation of the basic teachings of the present invention only; the extensions of the figures with respect to number, position, relationship, and dimensions of the parts to form the preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "lower", "upper", "outer", "top", "bottom", "inner", "end", "portion", "section", "longitudinal", "radial", "annular", "spacing", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

A tiltable sunshade according to the present invention is shown in the drawings and generally designated 12. Tiltable sunshade 12 includes a pole 111 having upper and lower ends 113 and 115 spaced along a longitudinal axis of pole 111. Pole 111 further includes inner and outer peripheries 114 and 112 extending between upper and lower ends 113 and 115, with inner and outer peripheries 114 and 112 spaced from each other in a radial direction perpendicular to the longitudinal axis of pole 111, and with inner periphery 114 defining a longitudinal hole 117. A slot 119 extends from outer periphery 112 through inner periphery 114 in the radial direction and includes first and second ends 131 and 133, with first end 131 of slot 119 located between upper end 113 of pole 111 and second end 133 of slot 119 along the longitudinal axis of pole 111. First and second holes 137 and 139 extend from outer periphery 112 through inner periphery 114 and are aligned with each other, with each of first and second holes 137 and 139 located between second end 133 of slot 119 and lower end 115 of pole 111. Pole 111 further includes a plurality of through-holes 135 extending from outer periphery 112 through inner periphery 114, with through-holes 135 spaced from each other in a circumferential direction about the longitudinal axis of pole 111. Lower end 115 of pole 111 is pivotably mounted to a base 467, allowing pole 111 to rotate about its longitudinal axis.

According to the form shown, pole 111 further includes a first transmission member 151 mounted in first hole 137. First transmission member 151 includes a toothed portion 155 with a flange 153 on a side thereof. An axle 157 extends away from the side of toothed portion 155, with an axle hole 159 extending from an end face of axle 157 through the other side of toothed portion 155 and having non-circular cross sections. Toothed portion 155 is received in longitudinal hole 117 of pole 111, with flange 153 abutting outer periphery 112 of pole 111, and with axle 157 located outside of pole 111. A seat 171 is fixed by screws to outer periphery 112 of pole 111 and includes a pivot hole 173 aligned with second hole 139 of pole 111 and axle hole 159 of first transmission member 151.

Figure 4:
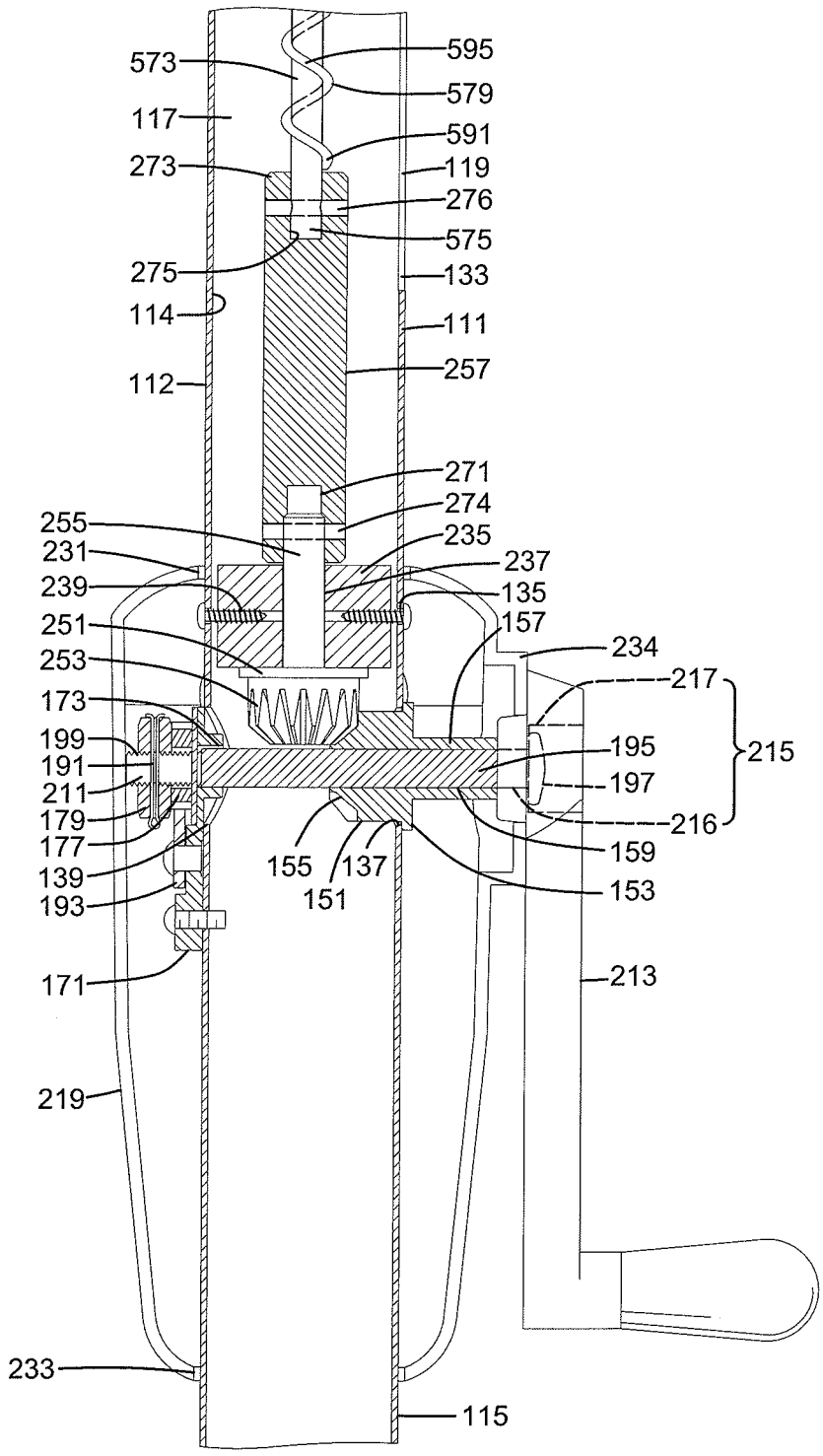
FIG. 4 shows a cross sectional view taken along section line 4-4 of FIG. 1.

According to the form shown, a shaft 195 has non-circular cross sections and includes a head 197 on an end thereof and a threaded portion 199 in the other end thereof, with threaded portion 199 having a groove 211. Shaft 195 is extended through axle hole 159 of first transmission member 151, with head 197 abutting the end face of axle 157 of first transmission member 151 (FIG. 4). Threaded portion 199 of shaft 195 extends through pivot hole 173 of seat 171, with a washer 175 and a nut 179 mounted around a section of threaded portion 199 located outside of seat 171. Thus, shaft 195 and first transmission member 151 are jointly rotatable about a rotating axis defined by a longitudinal axis of shaft 195 perpendicular to the longitudinal axis of pole 111. A ratchet wheel 177 is mounted around the section of threaded portion 199 and sandwiched between washer 175 and nut 179. A pin 191 is extended through nut 179 and groove 211 in shaft 195 (FIG. 4), preventing loosening of nut 179 during rotation of shaft 195. Thus, shaft 195 can not be disengaged from pole 111 in the radial direction. Furthermore, a catch 193 is fixed on seat 171 and releasably engaged with ratchet wheel 177.

According to the form shown, a handle 213 is mounted to shaft 195. Handle 213 includes a coupling hole 215 in the form shown as a through-hole having a coupling section 216 and a recessed section 217 having a diameter larger than that of coupling section 216. Coupling section 216 has cross sections the same as the cross sections of shaft 195. Shaft 195 is extended through coupling section 216, with head 197 received in recessed section 217. Thus, handle 213, shaft 195, and first transmission member 151 are jointly rotatable.

According to the form shown, a housing comprised of two housing halves 219 is mounted around pole 111 and surrounds first and second holes 137 and 139. Specifically, each housing half 219 includes upper and lower holes 231 and 233 and a pivotal portion 234 located between upper and lower holes 231 and 233. Housing halves 219 are mounted around pole 111, with pole 111 extending through upper holes 231 and lower holes 233. First transmission member 151, seat 171, washer 175, ratchet wheel 177, nut 179, and pin 191 are received in the housing (FIG. 4), with handle 213 located outside of the housing, and with shaft 195 extending out of the housing via pivotal portions 234 for engagement with handle 213.

According to the form shown, a support 235 is fixed in longitudinal hole 117 of pole 111 and includes upper and lower faces spaced along the longitudinal axis of pole 111. A shaft hole 237 extends from the upper face through the lower face of support 235. Support 235 includes a plurality of fixing holes 239 aligned with through-holes 135 in pole 111. Screws are extended through through-holes 135 of pole 111 into fixing holes 239 of support 235, fixing support 235 in pole 111 in a location between second end 133 of slot 119 of pole 111 and first transmission member 151 (FIG. 4).

According to the form shown, a second transmission member 251 is rotatably supported by support 235. Second transmission member 251 includes a toothed portion 253 meshed with toothed portion 155 of first transmission member 151 and a shaft 255 rotatably extending through shaft hole 237, with a distal end of shaft 255 located outside of support 235. Thus, when first transmission member 151 rotates, second transmission member 251 rotates about the longitudinal axis of pole 111.

According to the form shown, a connecting member 257 is fixed to second transmission member 251. Connecting member 257 includes a first end 259 and a second end 273 spaced from first end 259 along the longitudinal axis of pole 111, with a first receptacle 271 defined in an end face of first end 259, and with a second receptacle 275 defined in an end face of second end 273. The distal end of shaft 255 of second transmission member 251 is received in first receptacle 271. A first pin 274 is extended in a radial direction through first end 259 of connecting member 257 and the distal end of shaft 255. Thus, first end 259 of connecting member 257 is fixed to shaft 255, allowing joint rotation of connecting member 257 and second transmission member 251. Support 235 is located between second transmission member 251 and connecting member 257, preventing movement of second transmission member 251 and connecting member 257 along the longitudinal axis of pole 111.

According to the form shown, a rod assembly 571 includes a rod 573 and a helical spring 579 mounted around rod 573. Rod 573 is fixed to connecting member 257 to rotate therewith. Specifically, rod 573 includes a lower end 575 and an upper end 577 above lower end 575 along the longitudinal axis of pole 111. Lower end 575 of rod 573 is located between upper end 577 and support 235 along the longitudinal axis of pole 111. Lower end 575 of rod 573 is received in second receptacle 275. A second pin 276 extends through second end 273 of connecting member 257 and lower end 575 of rod 573. Thus, second transmission member 251 can drive connecting member 257 and rod 573 to rotate jointly.

Helical spring 579 includes a first fixing end 591 and a second fixing end 593 above first fixing end 591 along the longitudinal axis of pole 11. Helical spring 579 further includes a small pitch portion 597 at second fixing end 593 and a large pitch portion 595 extending from a lower end of small pitch portion 597 to first fixing end 591. Each of small and large pitch portions 597 and 595 has an inner diameter slightly larger than an outer diameter of rod 573. The inner diameter, outer diameter, and wire diameter of small pitch portion 597 are equal to the inner diameter, outer diameter, and wire diameter of large pitch portion 595, respectively. Large pitch portion 595 has a pitch in a range between 7 mm and 12 mm. Small pitch portion 597 has a pitch in a range between 2 mm and 4 mm.

Helical spring 579 is mounted around an outer periphery of rod 573 in an uncompressed state, with an inner side of helical spring 579 abutting the outer periphery of rod 573. Thus, helical spring 579 does not twist when subjected to an external force. First fixing end 591 of helical spring 579 is fixed to rod 573 at a location adjacent lower end 575 such as by welding. Second fixing end 593 of helical spring 579 is fixed to rod 573 at a location adjacent to upper end 577 such as by welding. Thus, helical spring 579 and rod 573 rotate jointly, and helical spring 579 can not be disengaged from rod 573 along a longitudinal axis of rod 573. If large pitch portion 595 or small pitch portion 597 is subjected to an external force along the longitudinal axis of rod 573 larger than the elasticity of helical spring 579, helical spring 579 deforms along the longitudinal axis of rod 573, causing a temporary increase or temporary decrease in the pitches of large pitch portion 595 and small pitch portion 597.

Figure 5:
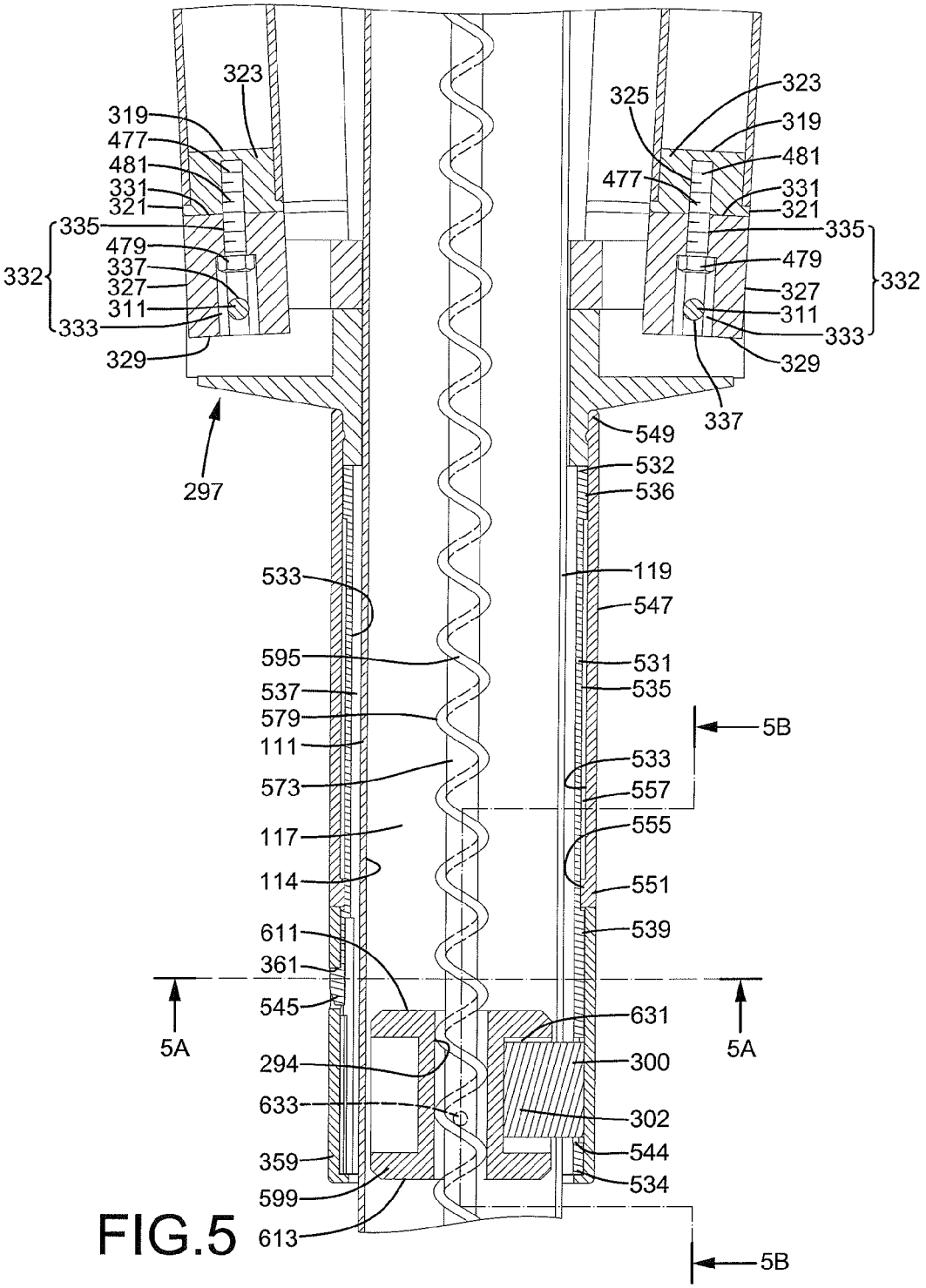
FIG. 5 shows a cross sectional view taken along section line 5-5 of FIG. 1.
Figure 5A:
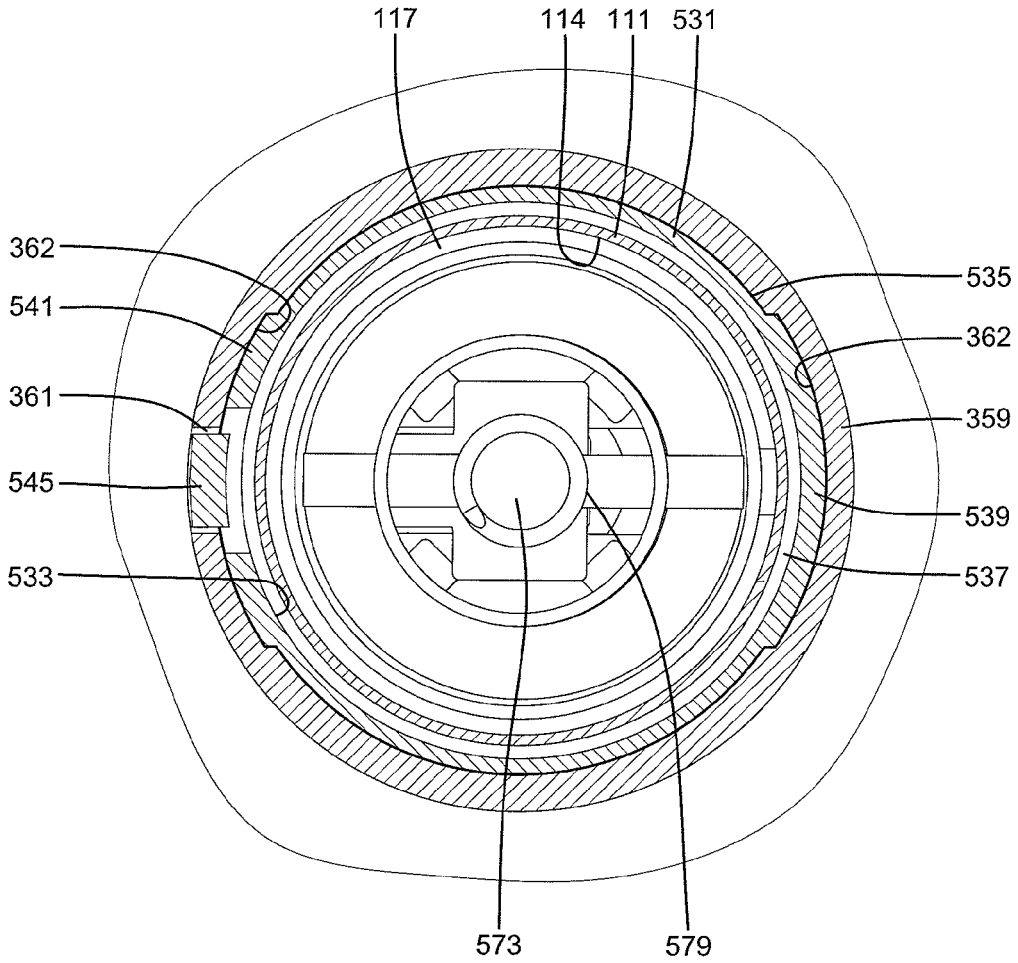
FIG. 5A shows a cross sectional view taken along section line 5A-5A of FIG. 5.
Figure 5B:
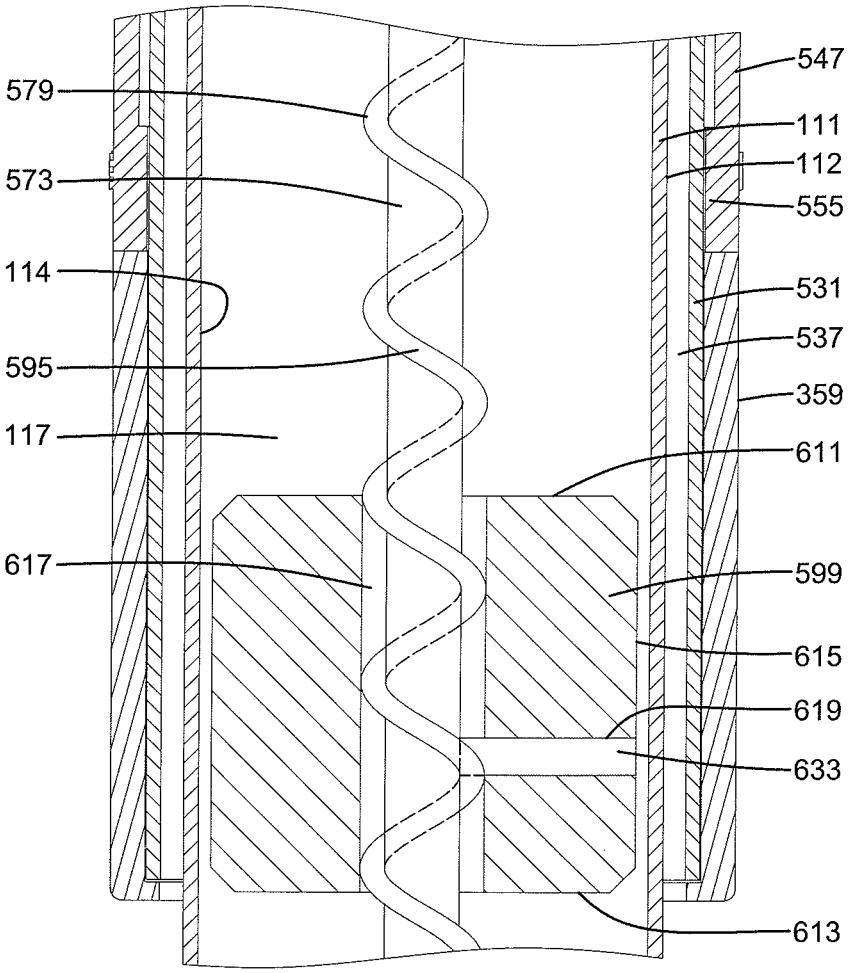
FIG. 5B shows a cross sectional view taken along section line 5B-5B of FIG. 5.

According to the form shown, a follower 599 is threadedly engaged with rod assembly 571. Follower 599 includes first and second faces 611 and 613 spaced from each other along the longitudinal axis of pole 111 and an outer periphery 615 extending between first and second faces 611 and 613. A hole 617 extends from first face 611 through second face 613 and has an inner diameter slightly larger than the outer diameter of helical spring 579. A pin hole 619 extends from outer periphery 615 through hole 617. An engagement hole 631 is formed in outer periphery 615 but spaced from hole 617. A pin 633 is fixed in pin hole 619 and has an end received in hole 617 of follower 599 (FIG. 5B).

Rod assembly 571 extends through hole 617 of follower 599, with a portion of the outer side of helical spring 579 abuts an inner periphery of hole 617. The other end of pin 633 abuts the outer periphery of rod 573 (FIG. 5B). Thus, follower 599 is threadedly connected to rod assembly 571 through pin 633.

Figure 13:
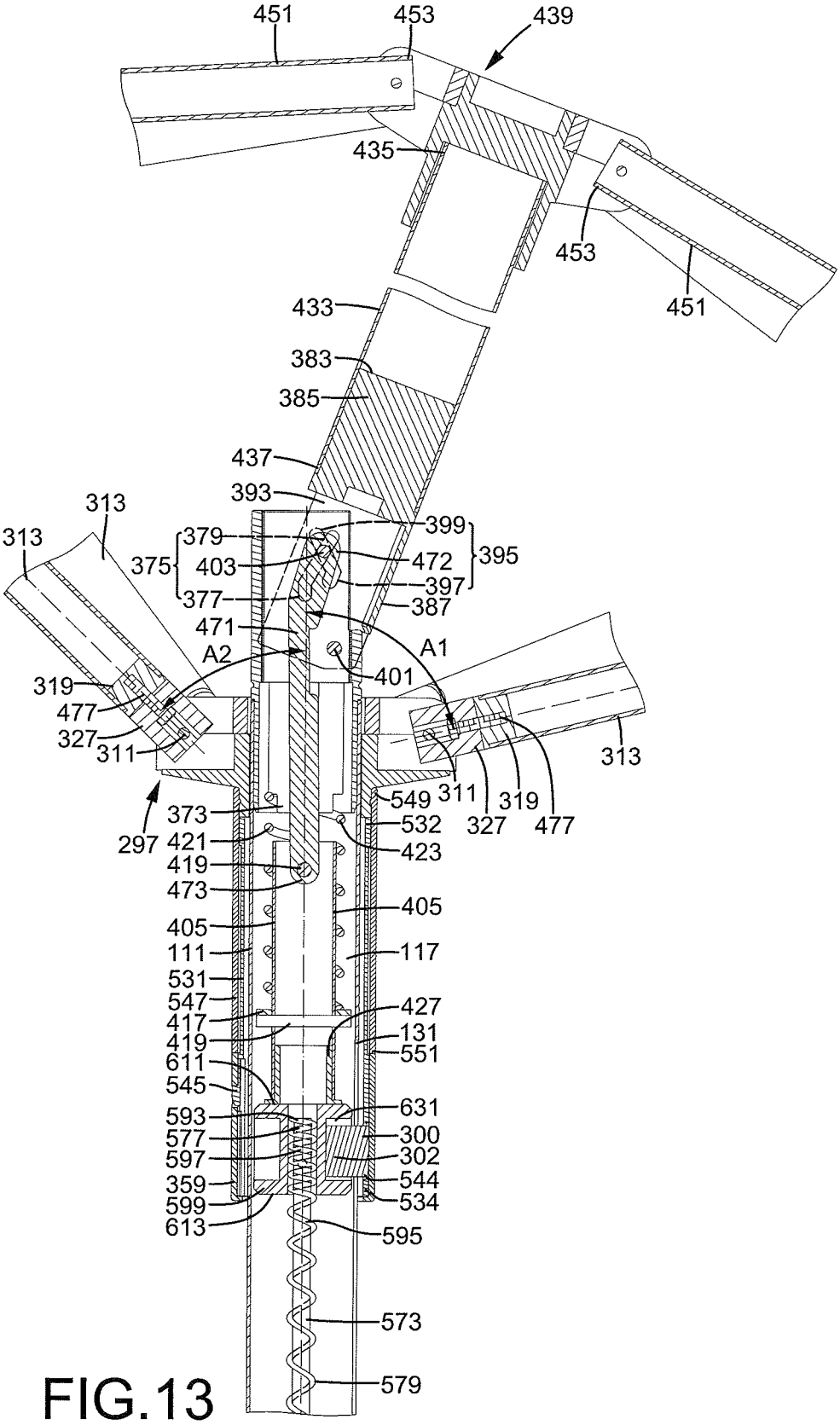
FIG. 13 shows a cross sectional view taken along section line 13-13 of FIG. 12.

Rotation of rod assembly 571 causes movement of follower 599 along the longitudinal axis of pole 111 between a folded position (FIG. 5), an unfolded position (FIG. 11), and a tilted position (FIG. 13). A first spacing between follower 599 in the folded position and second transmission member 251 along the longitudinal axis of pole 111 is smaller than a second spacing between follower 599 in the unfolded position and second transmission member 251 along the longitudinal axis of pole 111. The second spacing between follower 599 in the unfolded position and second transmission member 251 is smaller than a third spacing between follower 599 in the tilted position and second transmission member 251 along the longitudinal axis of pole 111.

A length of large pitch portion 595 along the longitudinal axis of pole 111 is slightly larger than travel of follower 599 from the folded position to the unfolded position. A length of small pitch portion 597 along the longitudinal axis of pole 111 is slightly larger than travel of follower 599 from the unfolded position to the tilted position.

According to the form shown, a receiving tube 531 is mounted around pole 111 and slideable relative to pole 111 along the longitudinal axis of pole 111. Receiving tube 531 includes a top end 532 and a bottom end 534. Receiving tube 531 further includes inner and outer peripheries 533 and 535 extending between top and bottom ends 532 and 534, with inner periphery 533 spaced from outer periphery 535 in the radial direction, and with inner periphery 533 defining a longitudinal hole 537. A flange 536 is formed on outer periphery 535 and located on top end 532. First and second protruded portions 539 and 541 are formed on outer periphery 535 and located at bottom end 534. An engagement groove 543 is defined in first protruded portion 539 and has a bottom wall spaced from inner periphery 533. A slot 544 extends from the bottom wall of engagement groove 543 through inner periphery 533 of receiving tube 531. A retaining portion 545 is formed on second protruded portion 541. Longitudinal hole 537 of receiving tube 531 receives pole 111, with slot 544 of receiving tube 531 aligned with slot 119 of pole 111.

According to the form shown, an engagement member 300 is mounted in engagement groove 543 of receiving tube 531. Engagement member 300 includes a body 304 received in engagement groove 543 and an insertion portion 302 extending from body 304. Insertion portion 302 extends through slot 544 of receiving tube 531 and slot 119 of pole 111 and engages with engagement hole 631 of follower 599. Thus, receiving tube 531 and follower 599 are jointly movable between the folded position, the unfolded position, and the tilted position. Engagement member 300 prevents rotation of follower 599 relative to pole 111, such that rotation of rod assembly 571 merely causes movement of follower 599 along the longitudinal axis of pole 111. A fixing sleeve 359 is mounted around bottom end 534 of receiving tube 531 and includes two sliding grooves 362 in an inner periphery thereof, with a retaining hole 361 extending from a bottom wall of one of sliding grooves 362 through an outer periphery of fixing sleeve 359. Retaining portion 545 of receiving tube 531 is engaged in retaining hole 361 (FIG. 5). First and second protruded portions 539 and 541 are received in sliding grooves 362 (FIG. 5A), preventing engagement member 300 from disengaging from engagement hole 631 of follower 599.

According to the form shown, a sliding sleeve 547 includes an abutment end 549 and a positioning end 551 spaced from abutment end 549 along the longitudinal axis of pole 111. Sliding sleeve 547 further includes an inner periphery 553 extending between abutment end 549 and positioning end 551 and defining a sliding hole 557. Two inner protruded portions 555 are formed on inner periphery 553 and located at positioning end 551. Receiving tube 531 is slideably received in sliding hole 557 of sliding sleeve 547. Positioning end 551 of sliding sleeve 547 abuts an upper end of fixing sleeve 359. Each inner protruded portion 555 is located between flange 536 of receiving tube 531 and fixing sleeve 359. Thus, each inner protruded portion 555 is movable between flange 536 of receiving tube 531 and fixing sleeve 359 when sliding sleeve 547 moves in the longitudinal axis of pole 111.

According to the form shown, a runner 297 is mounted around pole 111 and slideable relative to pole 111 along the longitudinal axis of pole 111. Runner 297 includes a lower end 307 and a plurality of pivotal pins 311 spaced in a circumferential direction about the longitudinal axis of pole 111. Lower end 307 of runner 297 is securely received in a top end of sliding sleeve 547. Lower end 307 of runner 297 abuts top end 532 of receiving tube 531 in the folded position. Thus, runner 297, receiving tube 531, fixing sleeve 359, engagement member 300, and follower 599 move jointly between the folded position, the unfolded position, and the tilted position by operating handle 213. When sliding sleeve 547 moves between flange 536 of receiving tube 531 and fixing sleeve 359, runner 297 moves jointly with sliding sleeve 547.

According to the form shown, a pivotal seat 327 is pivotably connected to each pivotal pin 311. Each pivotal seat 327 includes a first surface 329 and a second surface 331 opposite to first surface 329, with a mounting hole 332 extending from first surface 329 through second surface 331. Mounting hole 332 includes a larger hole section 333 in first surface 329 and a smaller hole section 335 in second surface 331, with larger hole section 333 having non-circular cross sections. Each pivotal seat 327 further includes a pivotal hole 337 extending perpendicularly to and intersecting with larger hole section 333. Each pivotal pin 311 is received in pivotal hole 337 of one of pivotal seats 327, allowing pivotal seat 327 to pivot about a pivot axis defined by pivotal pin 311.

According to the form shown, a screw 477 is mounted in mounting hole 332 of each pivotal seat 327 and includes a head 479 having non-circular cross sections the same as those of larger hole section 333 and includes a shank 481 having an outer thread. Head 479 of each screw 477 is received in larger hole section 333 of one of pivotal seats 327, preventing screw 477 from rotating relative to pivotal seat 327. Shank 481 extends through smaller hole section 335 and extends out of pivotal seat 327. After installation, each screw 477 is spaced from a corresponding pivotal pin 311 along the longitudinal axis of pole 111 (FIG. 5).

According to the form shown, a plug 319 is threadedly engaged with shank 481 of each screw 477 extending beyond pivotal seat 327. Each plug 319 includes a coupling portion 323, with a flange 321 formed on a side of coupling portion 323, and with a screw hole 325 defined in the side of coupling portion 323 and surrounded by flange 321. Shank 481 of each screw 477 is loosely engaged in screw hole 325 of one of plugs 319, allowing each plug 319 to pivot about a pivot axis defined by screw 477 while preventing plug 319 from disengaging from screw 477.

According to the form shown, a stretcher 313 is connected to each plug 319. Each stretcher 313 includes a first end 315 securely receiving coupling portion 323 of one of plugs 319, allowing each stretcher 313 and the corresponding pivotal seat 327 to pivot about the pivot axis defined by a corresponding pivotal pin 311. Furthermore, each plug 319 and the corresponding stretcher 313 are jointly pivotable about the pivot axis defined by the corresponding screw 477. Furthermore, each stretcher 313 is jointly movable together with runner 297 and follower 599 between the folded position, the unfolded position, and the tilted position. Each stretcher 313 further has a second end 317.

According to the form shown, a fixing member 363 is mounted to upper end 113 of pole 111 and includes a receiving section 365 having circular cross sections and a pivotal section 367, with pivotal section 367 having substantially U-shaped cross sections and having two sidewalls 368. A shoulder 369 is formed on an intersection of receiving section 365 and pivotal section 367. Fixing member 363 includes a compartment 371 extending from receiving section 365 through pivotal section 367, with compartment 371 located between two sidewalls 368 of pivotal section 367. Each sidewall 368 includes a sliding groove 375 in communication with compartment 371. Sliding groove 375 of each sidewall 368 includes a first section 377 parallel to the longitudinal axis of pole 111 and a second section 379 at an obtuse angle (about 150° in the form shown, see FIG. 6) to first section 377. Each sidewall 368 further includes a pin hole 381 located between sliding groove 375 and receiving section 365. A plurality of abutment protrusions 373 is defined in compartment 371 in receiving section 365. Receiving section 365 of fixing member 363 is fixed in longitudinal hole 117 at upper end 113 of pole 111.

According to the form shown, a pivotable member 383 is pivotably mounted to pivotal section 367 of fixing member 363. Pivotable member 383 includes an engaging portion 385 and a pivotal portion 387. Pivotal portion 387 includes a lower end having a lower end face 389 and an abutment face 391 at an obtuse angle (about 159° in the form shown, see FIG. 6) to lower end face 389. Pivotal portion 387 further includes two lateral walls 388 spaced from each other in a direction perpendicular to the longitudinal axis of pivotable member 383. A receiving space 393 is defined in lower end face 389 and located between lateral walls 388 of pivotal portion 387. Each lateral wall 388 includes a track 395 extending into receiving space 393 in the radial direction, with track 395 having a first track section 397 and a second track section 399 at an obtuse angle (about 135° in the form shown, see FIG. 6) to first track section 397. Each lateral wall 388 further includes a pivot hole 394 located between track 395 and lower end face 389. Pivotal section 367 of fixing member 363 is received in receiving space 393 of pivotable member 383, with sidewalls 368 of fixing member 363 located between lateral walls 388 of pivotable member 383. Pivot holes 394 of pivotable member 383 are aligned with pin holes 381 of fixing member 363, with lower end face 389 of pivotable member 383 spaced from shoulder 369 of fixing member 363 along the longitudinal axis of pole 111.

According to the form shown, a pin 401 is extended through pivot holes 394 of pivotable member 383 and pin holes 381 of fixing member 363, allowing pivotable member 383 to pivot about a pivot axis defined by pin 401 between a first position (FIGS. 1, 6, 10, and 11) and a second position (FIGS. 12 and 13) in a pivotal movement plane, with the pivotal movement plane being perpendicular to the pivot axis defined by pin 401 and including the longitudinal axis of pivotable member 383. When pivotable member 383 is in the first position (see FIG. 6), first track sections 397 of tracks 395 of pivotable member 383 are aligned with first sections 377 of sliding grooves 375 of fixing member 363. Furthermore, the longitudinal axis of pivotable member 383 is coaxial to the longitudinal axis of pole 111. Abutment face 391 of pivotable member 383 provides room for the pivotal movement of pivotable member 383 from the first position to the second position. While pivotable member 383 is moving from the first position to the second position, lower end face 389 of pivotable member 383 does not interfere with shoulder 369 of fixing member 363. On the other hand, when pivotable member 383 is in the second position, abutment face 391 of pivotable member 383 is substantially parallel to shoulder 369 of fixing member 363 (FIG. 13). In the form shown, an extension tube 433 includes a lower end 437 fixed to engaging portion 385 of pivotable member 383 and an upper end 435.

Figure 6:
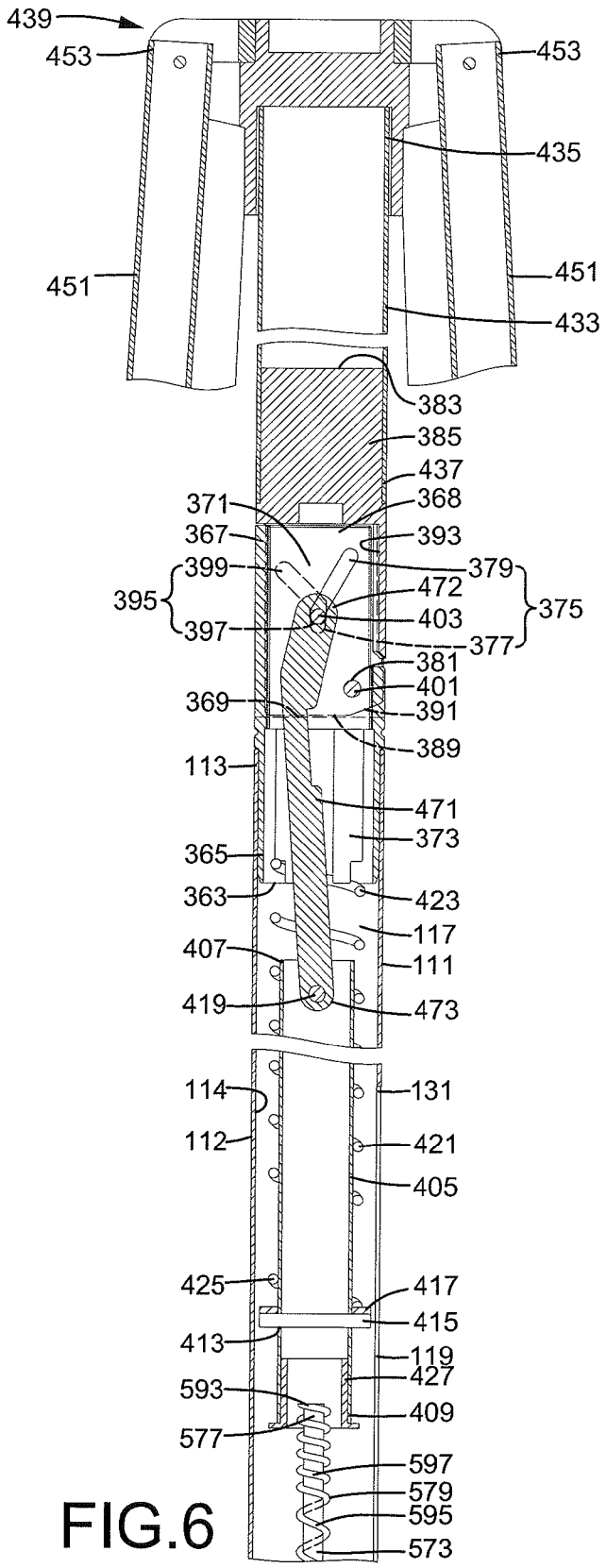
FIG. 6 shows a cross sectional view taken along section line 6-6 of FIG. 1.

According to the form shown, an actuation rod 403 is slideably received in tracks 395 of pivotable member 383 and sliding grooves 375 of fixing member 363. When pivotable member 383 is in the first position, actuation rod 403 is in first track sections 397 of tracks 395 of pivotable member 383 and first sections 377 of sliding grooves 375 of fixing member 363 (FIG. 6).

According to the form shown, a link 471 includes a first connection end 472 connected to actuation rod 403 and a second connection end 473. First connection end 472 is received in compartment 371 of fixing member 363. Second connection end 473 of link 471 is located in longitudinal hole 117 of pole 111. A connection member 405 includes a first end 407 pivotably connected to second connection end 473 of link 471 and a second end 409 below first end 407. Connection member 405 includes aligned first positioning holes 411 defined in first end 407 and aligned second positioning holes 413 between second end 409 and first positioning holes 411. A pin 419 is extended through first positioning holes 411 of first end 407 of connection member 405 and second connection end 473 of link 471. Thus, link 471 is pivotably connected to connection member 405. Second fixing end 593 of helical spring 579 is received in connection member 405. A positioning pin 415 is extended through second positioning holes 413 of connection member 405 in a radial direction perpendicular to the longitudinal axis of pole 111, with two ends of positioning pin 415 located outside of connection member 405.

According to the form shown, an abutment member 417 is annular and rests on exposed ends of positioning pin 415. A cap 427 includes a tubular portion 431 engaged in second end 409 of connection member 405. A flange 429 is formed on a lower side of tubular portion 431 and abuts an end face of second end 409 of connection member 405. A spring 421 is mounted around connection member 405 and includes a first end 423 abutting lower ends of abutment protrusions 373 of fixing member 363. Spring 421 further includes a second end 425 abutting abutment member 417. Spring 421 biases connection member 405 to retain pivotable member 383 in the first position (FIG. 6).

According to the form shown, a hub 439 is fixed on upper end 435 of extension tube 433. Pivotable member 383, extension tube 433 and hub 439 are jointly moveable between the first and second positions about the pivot axis defined by pin 401. A plurality of ribs 451 is provided, with each rib 451 including a connecting end 453 pivotably connected to hub 439 (FIG. 6), with second end 317 of each stretcher 313 pivotably connected to one of ribs 451. A canopy 475 is mounted to ribs 451.

Figure 7:
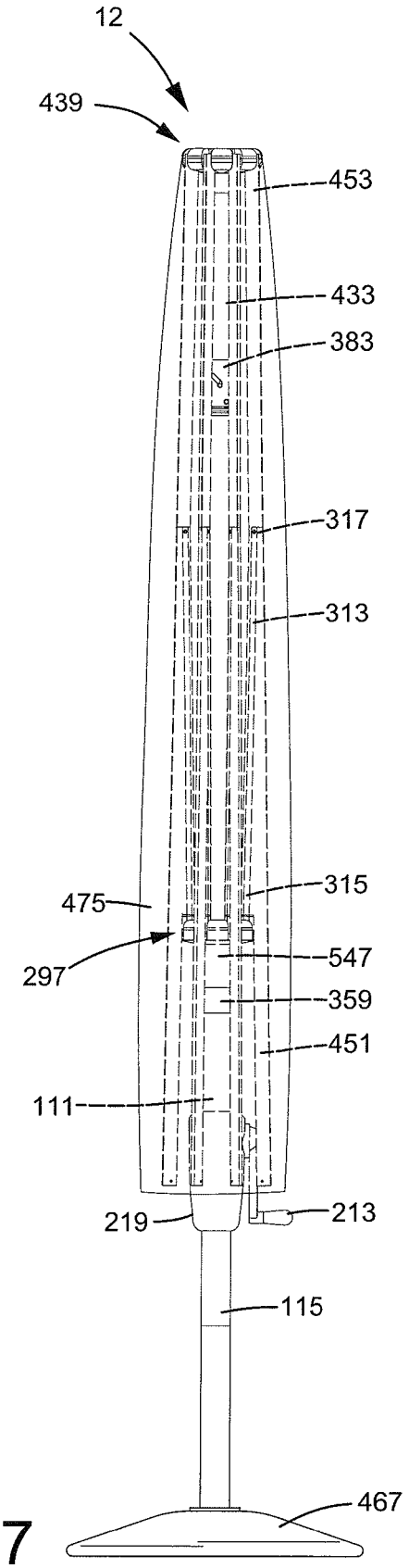
FIG. 7 shows a left side view of the tiltable sunshade of FIG. 1.

Now that the basic construction of tiltable sunshade 12 of the present invention has been explained, the operation and some of the advantages of tiltable sunshade 12 can be set forth and appreciated. In particular, for the sake of explanation, it will be assumed that follower 599 of tiltable sunshade 12 is located in the folded position (FIG. 5). Positioning end 551 of sliding sleeve 547 abuts the upper end of fixing sleeve 359, preventing runner 297 from moving away from hub 439. Follower 599 is spaced from cap 427 along the longitudinal axis of pole 111 and around large pitch portion 595 of helical spring 579 and located adjacent to first fixing end 591. Engagement member 300 is adjacent to second end 133 of slot 119. Runner 297 is adjacent to housing halves 219 (FIG. 1). The longitudinal axis of pivotable member 383 is coaxial to the longitudinal axis of pole 111, such that extension tube 433 is coaxial to and aligned with pole 111. Each of ribs 451 and stretchers 313 is in the folded state and located adjacent to pole 111 so that canopy 475 is in a collapsed state. The distal ends of some ribs 451 are located in a rotating path of handle 213 (FIG. 7). Spring 421 biases pivotable member 383 to the first position (FIG. 6).

Figure 8:
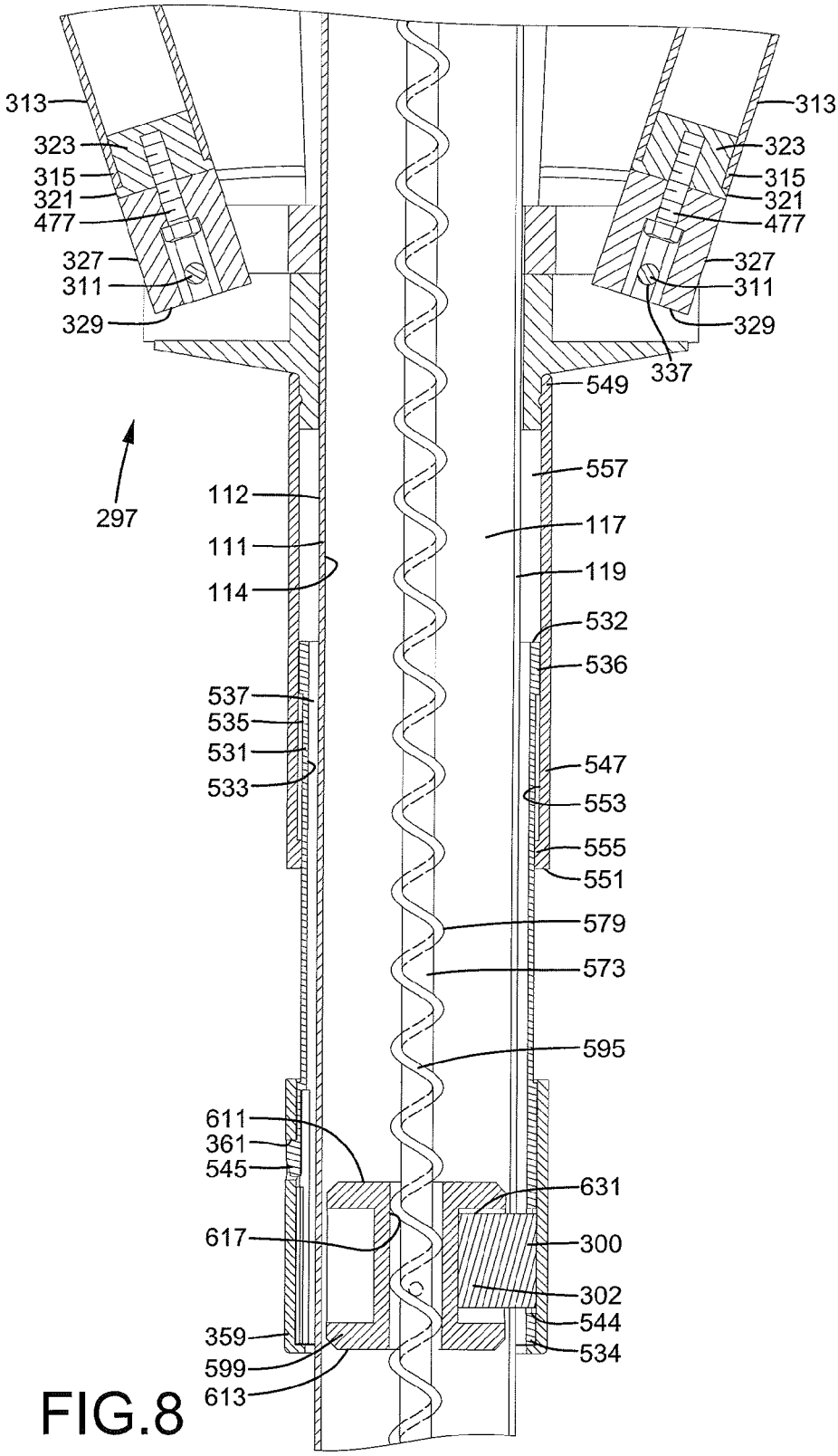
FIG. 8 shows a view similar to FIG. 5, with a sliding sleeve and a runner moved.

Before unfolding tiltable sunshade 12, one of ribs 451 is pulled or sliding sleeve 547 is moved towards hub 439 along the longitudinal axis of pole 111, such that runner 297 is moved through a small distance towards hub 439 without moving receiving tube 531, follower 599, and engagement member 300 (FIG. 8). Thus, each rib 451 is located outside of the rotating path of handle 213 (FIG. 9), allowing smooth rotation of handle 213 for opening tiltable sunshade 12.

Figure 9:
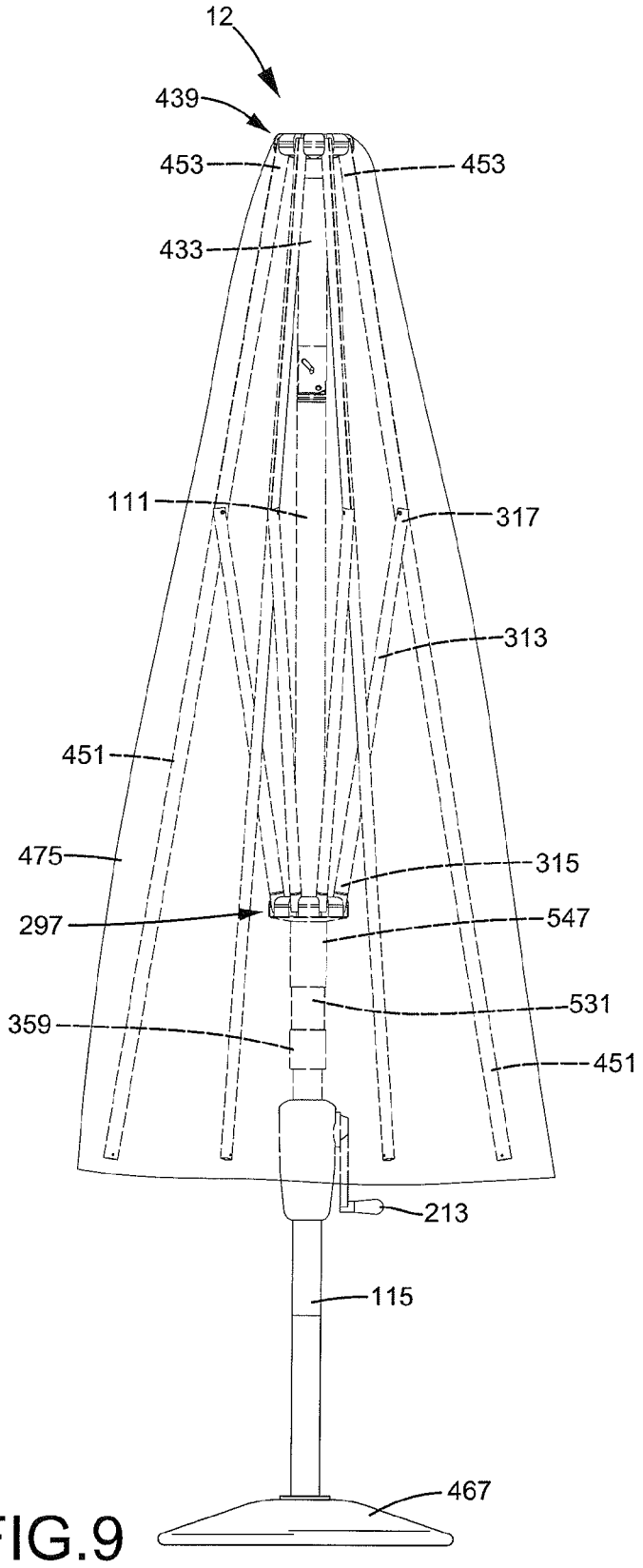
FIG. 9 shows a view similar to FIG. 7, with the sliding sleeve and the runner moved.
Figure 10:
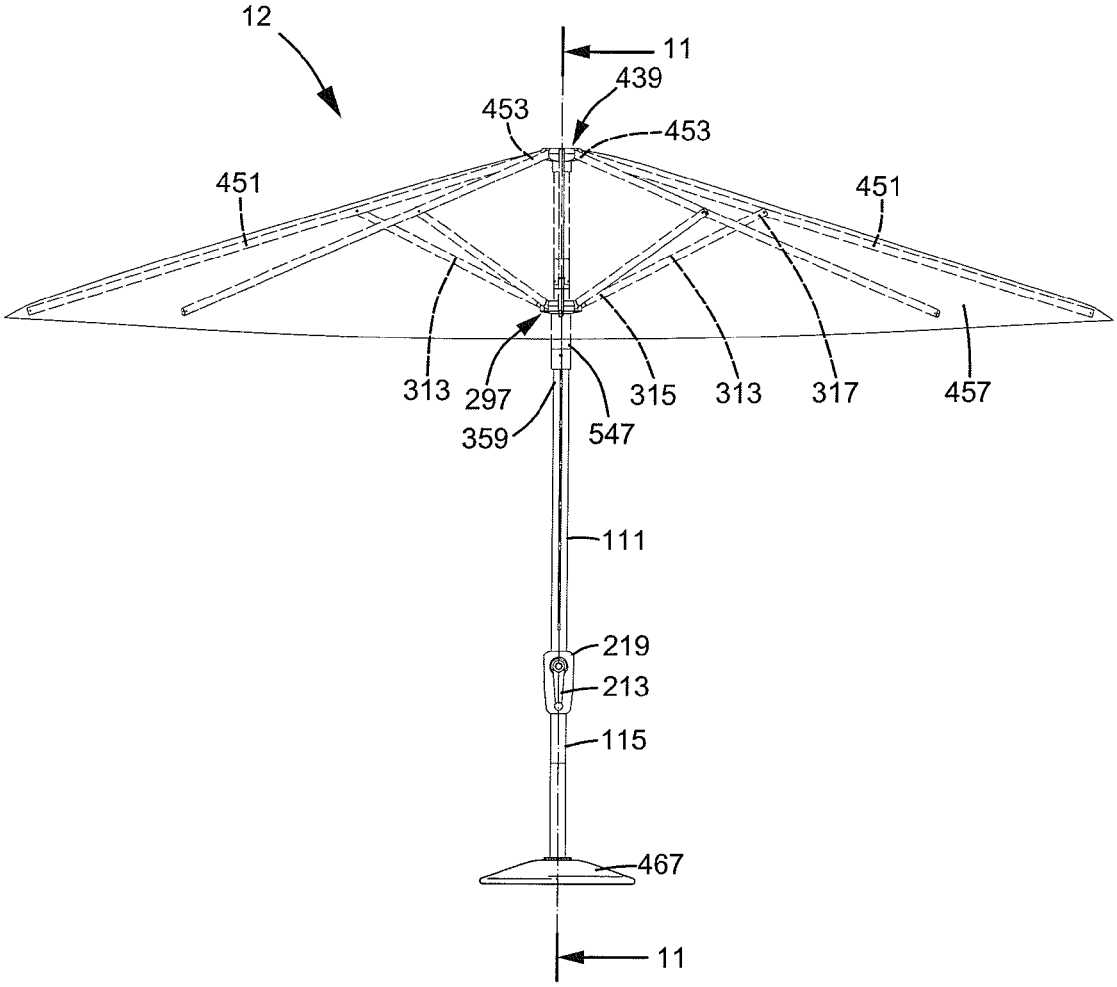
FIG. 10 shows a side elevational view of the tiltable sunshade in an unfolded state.
Figure 11:
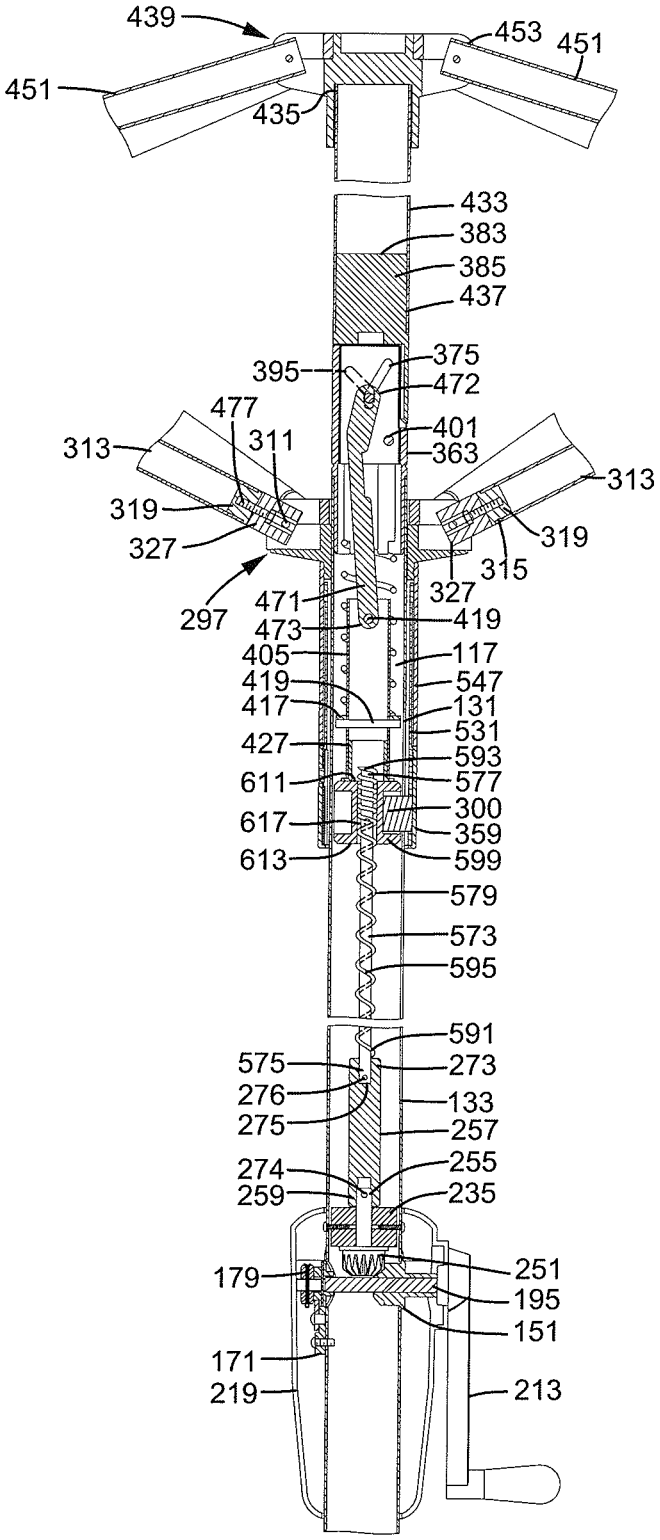
FIG. 11 shows a cross sectional view taken along section line 11-11 of FIG. 10.

When it is desired to open tiltable sunshade 12 in the state shown in FIG. 9, handle 213 is rotated in a direction to rotate shaft 195 and first transmission member 151, causing rotation of second transmission member 251 via transmission by toothed portions 155 and 253, which, in turn, causes rotation of connecting member 257 and rod assembly 571. Follower 599 moves from the folded position (FIG. 8) to the unfolded position (FIG. 11). Specifically, engagement member 300 pushes receiving tube 531 to move runner 297 towards hub 439, moving stretchers 313 and ribs 451 to extend canopy 475. Since follower 599 is around the large pitch portion 595 of helical spring 579, rotation of helical spring 579 pushes pin 633 and causes follower 599 to move rapidly from the folded position to the unfolded position at a first speed. When follower 599 reaches the unfolded position (FIG. 11), first face 611 of follower 599 abuts flange 429 of cap 427, pin 633 on follower 599 at an intersection between large pitch portion 595 and smaller pitch portion 597, and runner 297 is in a location adjacent to fixing member 363 and below pin 401. Canopy 475 is extended by ribs 451 and stretchers 313. Tiltable sunshade 12 is, thus, opened.

Figure 11A:
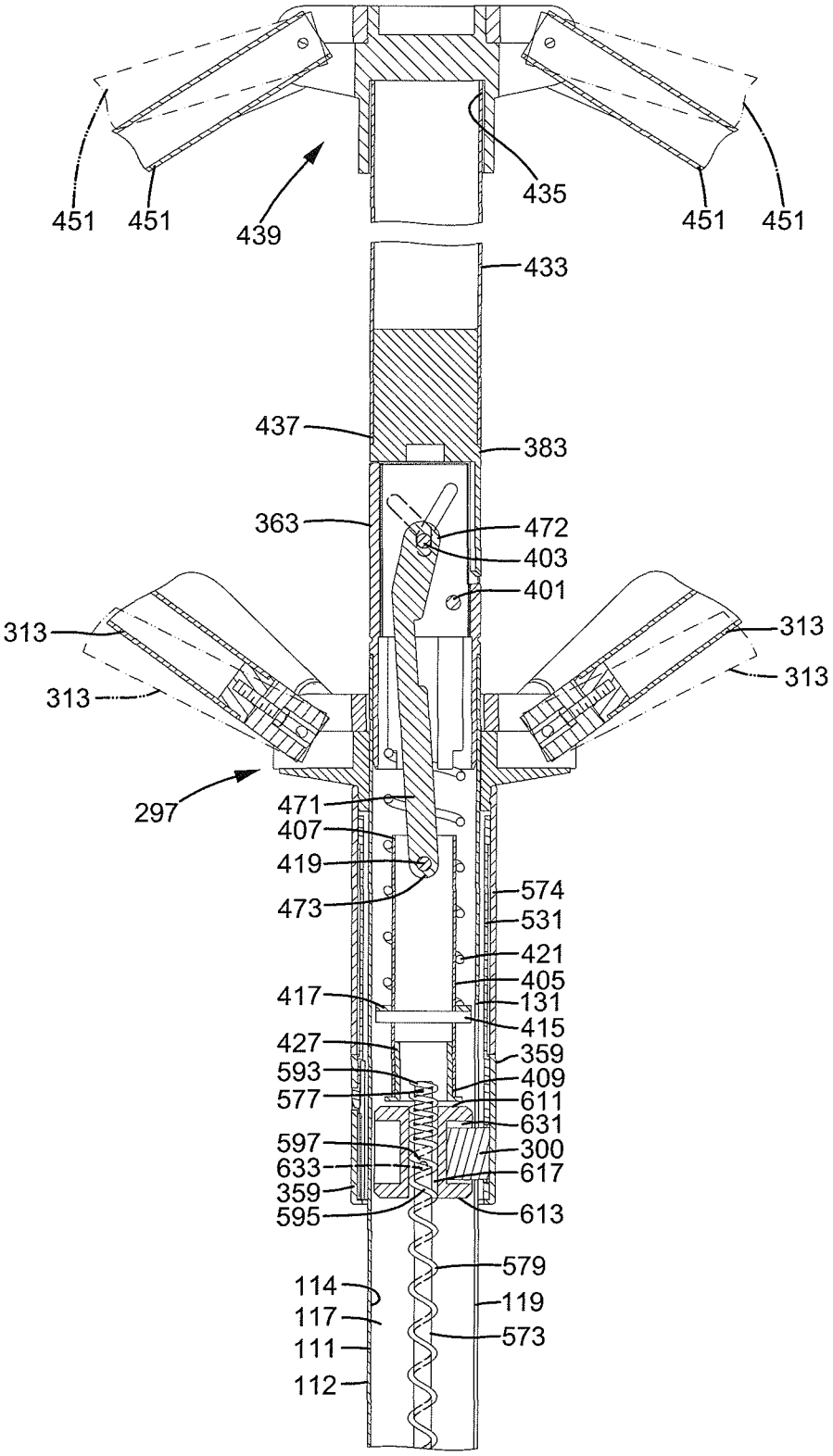
FIG. 11A shows a portion of the tiltable sunshade of FIG. 11, with a canopy of the tiltable sunshade under a strong wind load, with a rod of the rod assembly not rotated, with a helical spring on the rod deformed.

With reference to FIG. 11A, when canopy 475 of tiltable sunshade 12 is opened (FIGS. 10 and 11) and canopy 475, ribs 451, or stretchers 313 are subjected to an external force (such as under a strong wind load), if the external force imparted to follower 599 is larger than the elasticity of helical spring 579, follower 599 displaces along the longitudinal axis of rod 573, but rod assembly 571 does not rotate. Helical spring 579 moves together with follower 599 and undergoes elastic deformation. Namely, the pitches of large and smaller pitch portions 595 and 597 change temporarily. This allows runner 297 to slightly displace along the longitudinal axis of pole 111. Furthermore, each rib 451 and each stretcher 313 rotate through a small angle. A buffering effect is, thus, provided.

Figure 12:
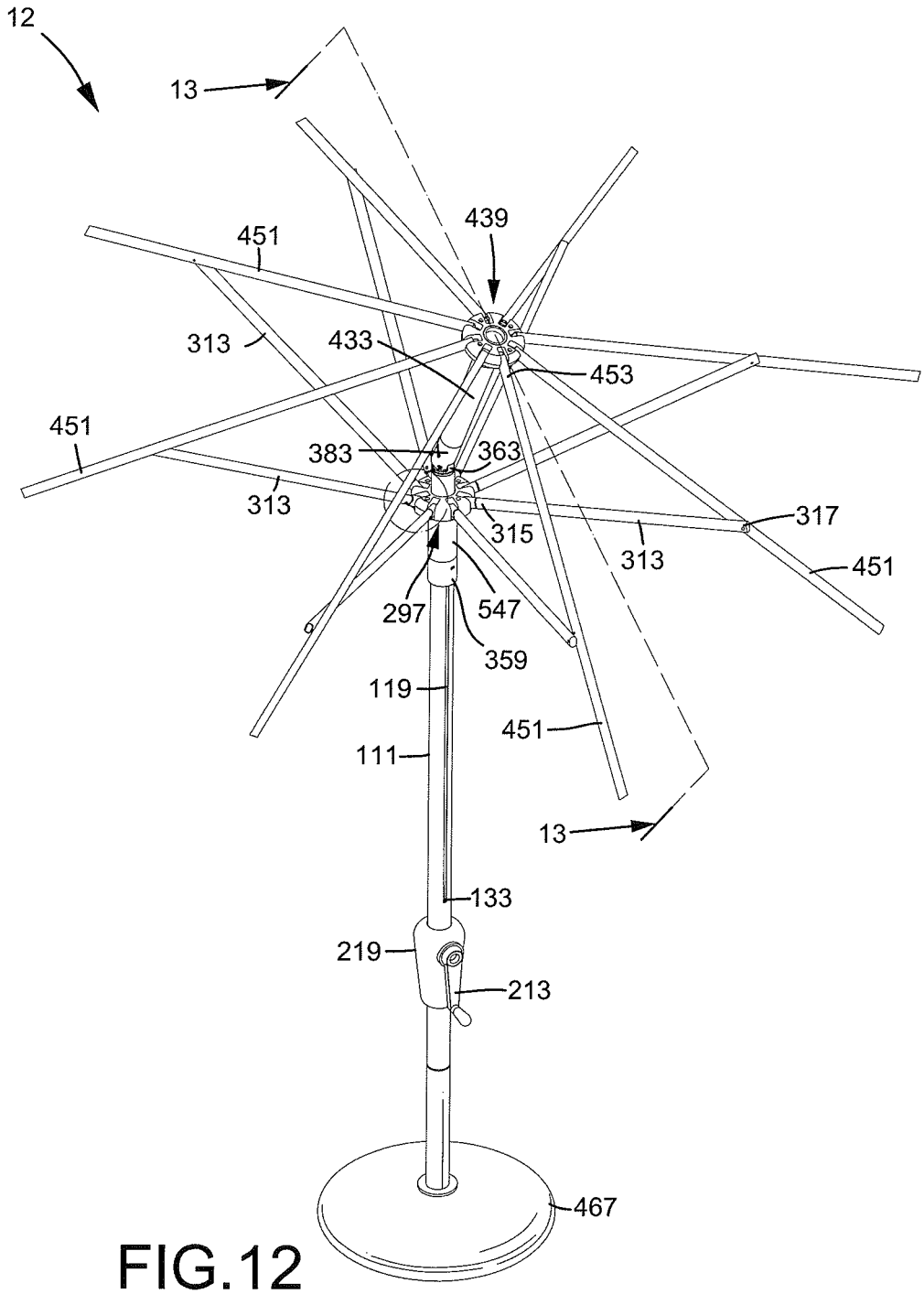
FIG. 12 shows a perspective view of the tiltable sunshade of FIG. 1, with the sunshade in a tilted state.

In a case that handle 213 is further rotated in the same direction while tiltable sunshade 12 is in the open state, follower 599 moves from the unfolded position to the tilted position (FIG. 12). Specifically, after follower 599 reaches the unfolded position, rotation of rod assembly 571 resulting from rotation of handle 213 in the same direction causes small pitch portion 597 of helical spring 579 to push pin 633. Thus, follower 599 moves slowly at a second speed smaller than the first speed from the unfolded position to the folded position. Follower 599 pushes cap 427, connection member 405, pin 419, positioning pin 415, and abutment member 417 to move along the longitudinal axis of pole 111 and compresses spring 421. First connection end 472 of link 471 pushes actuation rod 403 to move from first sections 377 of sliding grooves 375 of fixing member 363 into second sections 379. Actuation rod 403 presses against wall faces of tracks 395 of pivotable member 383 to pivot pivotable member 383 in the pivotal movement plane from the first position to the second position, leading to pivotal movement of extension tube 433, hub 439, and ribs 451 to a position in which extension tube 433 is at an obtuse angle to pole 111. Each stretcher 313 and the corresponding plug 319 move together with ribs 451 and, thus, pivot about the pivot axis defined by the corresponding pivotal pin 311. As a result, pivotable member 383 carries hub 439, extension tube 433, and ribs 451 to the second position (FIGS. 12 and 13). When pivotable member 383 reaches the second position, abutment face 391 is substantially parallel to shoulder 369 of fixing member 363, and runner 297 is still located below pin 401 along the longitudinal axis of pole 111. Canopy 475 is, thus, tilted. Pole 111 can be rotated relative to base 467 according to the position of the sun, providing a desired shielding effect.

Figure 12A:
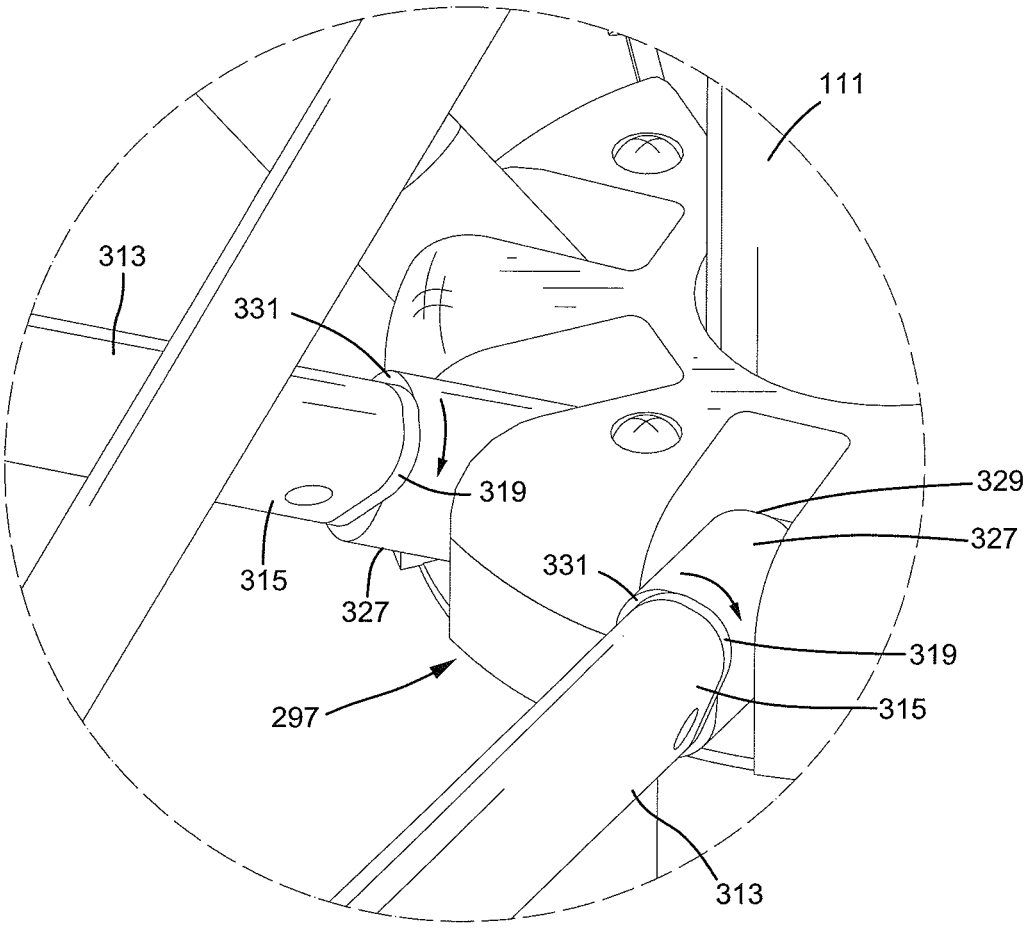
FIG. 12A shows an enlarged view of a circled portion of FIG. 12.

For stretchers 313 whose longitudinal axes are not located in the pivotal movement plane, each of these stretcher 313 not only pivots in the pivotal movement plane together with the corresponding rib 451 but also pivots about its longitudinal axis, as indicated by the arrows in FIG. 12A. Namely, each of these stretcher 313 pivots about the corresponding pivotal pin 311 and pivots about the corresponding screw 477. However, a stretcher 313 whose longitudinal axis is located in the pivotal movement plane will only pivot in the pivotal movement plane together with the corresponding rib 451 without pivotal movement about the corresponding screw 477. FIG. 13 shows movement of two stretchers 313 whose longitudinal axes are located in the pivotal movement plane. If pivotable member 383 is moved to the position shown in FIG. 13 in which the longitudinal axis of pivotable member 383 is at about 21° to the longitudinal axis of pole 111, the angle A2 between the longitudinal axis of the left stretcher 313 in FIG. 13 and the longitudinal axis of pole 111 is about 46°. Furthermore, the angle A1 between the longitudinal axis of the right stretcher 313 in FIG. 13 and the longitudinal axis of pole 111 is about 77°. Note that each of the stretchers 313 in FIG. 13 does not pivot about the corresponding screw 477.

Figure 13A:
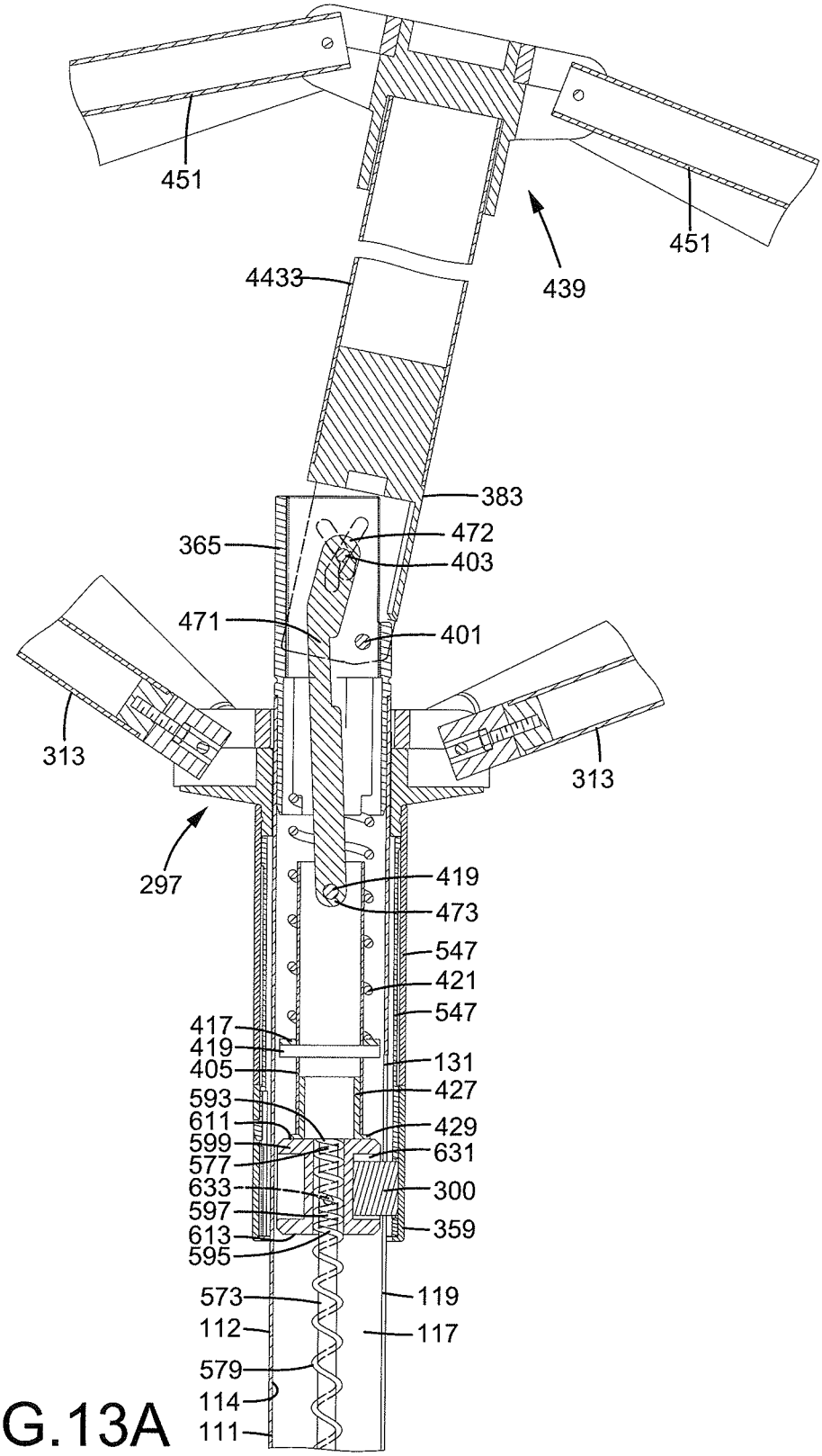
FIG. 13A is a view similar to FIG. 13, with the canopy of the tiltable sunshade under a strong wind load, with the rod of the rod assembly not rotated, with the helical spring on the rod deformed.

With reference to FIG. 13A, when pivotal member 383 is in the second position and canopy 475 of tiltable sunshade 12 is tilted (FIGS. 12 and 13), if canopy 475, ribs 451, or stretchers 313 are subjected to an external force (such as under a strong wind load), if the external force imparted to follower 599 is larger than the elasticity of helical spring 579, follower 599 displaces along the longitudinal axis of rod 573, but rod assembly 571 does not rotate. Helical spring 579 moves together with follower 599 and undergoes elastic deformation. Namely, the pitches of large and small pitch portions 595 and 597 change temporarily. This allows runner 297 to slightly displace along the longitudinal axis of pole 111. Furthermore, each rib 451 and each stretcher 313 rotate through a small angle, pivotable member 383 in the second position can pivoting towards the first position through a small angle. A buffering effect is, thus, provided.

Furthermore, if handle 213 is rotated in the same direction while pivotal member 383 is in the second position, helical spring 579 undergoes elastic deformation, keeping follower 599 in the tilted position. Thus, pin 633 is less likely to damage due to an excessive external force resulting from improper operation.

With tiltable sunshade 12 in the tilted state shown in FIG. 13 and if handle 213 is rotated in a reverse direction, follower 599 is driven by small pitch portion 597 of helical spring 579 to move slowly from the tilted position to the unfolded position along the longitudinal axis of pole 111, and spring 421 presses against abutment member 417, causing positioning pin 415, connection member 405, pin 419, link 471, and actuation rod 403 to move jointly along the longitudinal axis of pole 111 in a direction releasing spring 421. Actuation rod 403 presses against the wall faces of second track sections 399 of tracks 395 of pivotable member 383, causing pivotal movement of pivotable member 383 from the second position to the first position (FIG. 11). Further rotation of handle 213 in the reverse direction causes movement of follower 599 from the unfolded position to the folded position. Runner 297 and stretchers 313 move to their original positions shown in FIG. 1. Tiltable sunshade 12 is, thus, folded.

If handle 213 is further rotated in the reverse direction while tiltable sunshade 12 is in a position shown in FIG. 1, stretchers 313 will drag runner 297 to avoid runner 297 from moving towards housing halves 219. Thus, follower 599 is retained in the folded position, and helical spring 579 undergoes elastic deformation. As a result, pin 633 is less likely to damage due to an excessive external force resulting from improper operation.

Note that follower 599 is coupled to runner 297 through engagement member 300 such that the weights of runner 297, stretchers 313 and ribs 451 will impart a force to follower 599 and helical spring 579. Thus, helical spring 579 is configured to be sufficiently strong to withstand the force to reliably move follower 599 between the folded position, unfolded position, and the tilted position.

Since runner 297 is moved along the longitudinal axis of pole 111 by using rod assembly 571, less force is required to unfold canopy 475. Further, operation for tilting canopy 475 is force-saving by using rod assembly 571 to actuate follower 599 while providing reinforced structural strength. Further, large pitch portion 595 of helical spring 579 rapidly moves follower 599 between the folded position and the unfolded position, rapidly folding or unfolding canopy 475.

Furthermore, canopy 475 in the tilted state can be adjusted according to the position of the sun, providing enhanced sun-shielding effect. Furthermore, the angular displacement of pivotable member 383 about the pivot axis defined by pin 401 can be more precisely controlled by small pitch portion 597 of helical spring 579 that moves follower 599 slowly, precisely controlling the tilted state of canopy 475. Further, when pivotable member 383 is in the first position, first sections 377 of sliding grooves 375 of fixing member 363 and first track sections 397 of tracks 395 of pivotable member 383 are parallel to the longitudinal axis of pole 111 to reliably retain pivotable member 383 in the first position. Thus, pivotable member 383 would not pivot from the first position to the second position even if canopy 475 in the unfolded state is under a strong wind load. Furthermore, since each stretcher 313 can pivot about the corresponding screw 477 while tilting canopy 475, pivotable member 383 can smoothly pivot from the first position to the second position.

Furthermore, sliding sleeve 547 can push runner 297 towards hub 439 without moving receiving tube 531, engagement member 300, and follower 599, moving the distal end of each rib 451 out of the rotating path of handle 213. Thus, handle 213 can be smoothly rotated to unfold canopy 475 without interference by the distal end of any rib 451.

Furthermore, since helical spring 579 allows follower 599 to slightly displace along the longitudinal axis of rod 573 without causing rotation of rod assembly 571, a buffering effect is provided when canopy 475, stretchers 313, or ribs 451 are subjected to an external force while tiltable sunshade 12 is in the opened position or the tilted position, providing damage to tiltable sunshade 12.

Further, if handle 213 is further rotated in the reverse direction while follower 599 is in the folded position, or if handle 213 is further rotated in the unfolding direction while follower 599 is in the tilted position, helical spring 579 undergoes elastic deformation without moving follower 599, preventing damage to pin 633 by an excessive external force.

Now that the basic teachings of the present invention have been explained, many extensions and variations will be obvious to one having ordinary skill in the art. For example, helical spring 579 does not have to include small pitch portion 597; namely, helical spring 579 has a single pitch from first fixing end 591 to second fixing end 593. In this case, tilting control of canopy 475 of tiltable sunshade 12 without small pitch portion 597 is less accurate than that of canopy 475 of tiltable sunshade 12 with small pitch portion 597.

Furthermore, tiltable sunshade 12 does not have to include elements such as extension tube 433, fixing member 363, pivotable member 383, cap 427, spring 421, plugs 319, pivotal seats 327, and screws 477 as well as components directly coupled with these elements. In this case, hub 439 can be directly fixed to upper end 113 of pole 111. In this case, canopy 475 can not be moved to the tilted position but can still be folded or unfolded through rotation of rod assembly 571.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A tiltable sunshade comprising:

a pole (111) including upper and lower ends (113, 115) spaced from each other along a longitudinal axis of the pole (111), with the pole (111) further including an outer periphery (112) and an inner periphery (114) spaced from the outer periphery (112) in a radial direction perpendicular to the longitudinal axis of the pole (111), with the inner periphery (114) of the pole (111) defining a longitudinal hole (117), with the lower end (115) of the pole (111) adapted to be rotatably coupled to a base (467);

a rod (573) rotatably received in the longitudinal hole (117) of the pole (111);

a helical spring (579) mounted around the rod (573), with the helical spring (579) including first and second fixing ends (591, 593) fixed to the rod (573), with the rod (573) and the helical spring (579) jointly rotatable about the longitudinal axis of the pole (111);

a follower (599) received in the longitudinal hole (117) of the pole (111) and threadedly engaged with the helical spring (579), with rotation of the helical spring (579) about the longitudinal axis of the pole (111) causing movement of the follower (599) along the longitudinal axis of the pole (111) between a folded position and an unfolded position;

a runner (297) slideably mounted around the pole (111), with the runner (297) coupled to the follower (599), with the runner (297) and the follower (599) jointly moveable along the longitudinal axis of the pole (111);

a plurality of stretchers (313) each having a first end (315) pivotably connected to the runner (297) and a second end (317) spaced from the first end (315) along a longitudinal axis of the stretcher (313), with the plurality of stretchers (313) jointly movable with the runner (297) and the follower (599);

a hub (439) mounted to the upper end (113) of the pole (111); and a plurality of ribs (451) each including a connecting end (453) pivotably connected to the hub (439), with the second end (317) of each of the plurality of stretchers (313) pivotably connected to one of the plurality of ribs (451), with a canopy (475) adapted to be mounted to the plurality of ribs (451), wherein rotation of the helical spring (579) causes movement of the follower (599) between the folded position and the unfolded position, the runner (297) moves together with the follower (599) to open or collapse the canopy (475), and wherein when the follower (599) is in the unfolded position, if the canopy (475), the plurality of ribs (475), or the plurality of stretchers (451) is subjected to an external force causing the runner (297) to move along longitudinal axis of the pole (111), the helical spring (579) is compressed by the follower (599) and undergoes elastic deformation, providing a buffering effect to the external force.

2. A tiltable sunshade comprising:

a pole (111) including upper and lower ends (113, 115) spaced from each other along a longitudinal axis of the pole (111), with the pole (111) further including an outer periphery (112) and an inner periphery (114) spaced from the outer periphery (112) in a radial direction perpendicular to the longitudinal axis of the pole (111), with the inner periphery (114) of the pole (111) defining a longitudinal hole (117), with the lower end (115) of the pole (111) adapted to be rotatably coupled to a base (467);

a rod (573) rotatably received in the longitudinal hole (117) of the pole (111);

a helical spring (579) mounted around the rod (573), with the helical spring (579) including first and second fixing ends (591, 593) fixed to the rod (573), with the helical spring (579) further including a small pitch portion (597) at the second fixing end (593) and a large pitch portion (595) extending from a lower end of the small pitch portion (597) to the first fixing end (591), with the large pitch portion (595) of the helical spring (579) having a pitch larger than a pitch of the small pitch portion (597), with the rod (573) and the helical spring (579) jointly rotatable about the longitudinal axis of the pole (111);

a follower (599) received in the longitudinal hole (117) of the pole (111) and threadedly engaged with the helical spring (579), with rotation of the helical spring (579) about the longitudinal axis of the pole (111) causing movement of the follower (599) along the longitudinal axis of the pole (111) between a folded position, an unfolded position, and a tilted position;

a runner (297) slideably mounted around the pole (111), with the runner (297) coupled to the follower (599), with the runner (297) and the follower (599) jointly moveable along the longitudinal axis of the pole (111);

a plurality of stretchers (313) each having a first end (315) pivotably connected to the runner (297) and a second end (317) spaced from the first end (315) along a longitudinal axis of the stretcher (313), with the plurality of stretchers (313) jointly movable with the runner (297) and the follower (599);

a fixing member (363) fixed to the upper end (113) of the pole (111);

a pivotable member (383) pivotably connected to the fixing member (363);

a hub (439) mounted to the pivotable member (383), with the hub (439) and the pivotable member (383) jointly pivotable between a first position and a second position; and a plurality of ribs (451) each including a connecting end (453) pivotably connected to the hub (439), with the second end (317) of each of the plurality of stretchers (313) pivotably connected to one of the plurality of ribs (451), with a canopy (475) adapted to be mounted to the plurality of ribs (451), wherein when the follower (599) moves between the folded position and the unfolded position through rotation of the helical spring (579), the follower (599) is pushed by the large pitch portion (595) to move at a first speed, causing movement of the runner (297) to open or collapse the canopy (475), wherein when the follower (599) moves from the unfolded position to the tilted position through rotation of the helical spring (579), the follower (599) is pushed by the small pitch portion (597) to move at a second speed smaller than the first speed, the pivotal member (383) is actuated by the follower (599) to pivot from the first position to the second position in which the plurality of ribs (451) and the plurality of stretchers (313) are tilted, wherein when the follower (599) moves from the tilted position to the unfolded position through rotation of the helical spring (579), the follower (599) is pushed by the small pitch portion (597) to move at the second speed, the pivotal member (383) is actuated by the follower (599) to pivot from the second position to the first position in which the plurality of ribs (451) and the plurality of stretchers (313) are not tilted, and wherein when the follower (599) is in the unfolded position or the tilted position, if the canopy (475), the plurality of ribs (475), or the plurality of stretchers (451) is subjected to an external force causing the runner (297) to move along the longitudinal axis of the pole (111), the helical spring (579) is compressed by the follower (599) and undergoes elastic deformation, providing a buffering effect to the external force.

3. The tiltable sunshade as claimed in claim 2, with a first hole (137) extending from the outer periphery (112) through the inner periphery (114) of the pole (111), with the rod (573) including a lower end (575) and an upper end (577), with the first fixing end (591) of the helical spring (579) fixed to the rod (573) at a location adjacent to the lower end (575) of the rod (573), with the second fixing end (593) of the helical spring (579) fixed to the rod (573) at a location adjacent to the upper end (577) of the rod (573), with the fixing member (363) including a sliding groove (375) and a pin hole (381), with the pivotable member (383) including a track (395) and a pivot hole (394), with the tiltable sunshade (12) further comprising:

a first transmission member (151) rotatably mounted in the first hole (137), with the first transmission member (151) including a toothed portion (155) located in the longitudinal hole (117) of the pole (111);

a handle (213) located outside of the pole (111) and fixed to the first transmission member (151), with the handle (213) and the first transmission member (151) jointly rotatable about a rotating axis perpendicular to the longitudinal axis of the pole (111);

a support (235) fixed in the longitudinal hole (117) of the pole (111) and located between the first transmission member (151) and the helical spring (579) along the longitudinal axis of the pole (111);

a second transmission member (251) received in the longitudinal hole (117) of the pole (111), with the second transmission member (251) including a shaft (255) rotatably supported by the support (235), with the second transmission member (251) further including a toothed portion (253) meshed with the toothed portion (155) of the first transmission member (151), with the shaft (255) of the second transmission member (251) coupled to the lower end (575) of the rod (573), with the second transmission member (251), the rod (573), and the helical spring (579) jointly rotating about the longitudinal axis of the pole (111) when the first transmission member (151) rotates about the rotating axis;

a pin (401) extending through the pivot hole (394) of the pivotable member (383) and the pin hole (381) of the fixing member (363), with the pivotable member (383) pivotable relative to the fixing member (363) about a pivot axis defined by the pin (401) between the first position and the second position, with a longitudinal axis of the pivotable member (383) in the first position being coaxial to the longitudinal axis of the pole (111), with the longitudinal axis of the pivotable member (383) in the second position being at an obtuse angle to the longitudinal axis of the pole (111);

an actuation rod (403) slideably extending through the sliding groove (375) of the fixing member (363) and slideably received in the track (395) of the pivotable member (383);

a link (471) including a first connection end (472) connected to the actuation rod (403) and a second connection end (473);

a connection member (405) including a first end (407) pivotably connected to the second connection end (473) of the link (471) and a second end (409);

a positioning pin (415) extending through the connection member (405) in a radial direction perpendicular to the longitudinal axis of the pole (111), with the positioning pin (415) having two ends located outside of the connection member (405);

a spring (421) mounted around the connection member (405) and including a first end (423) abutting the fixing member (363) and a second end (425) abutting the two ends of the positioning pin (415);

with a first spacing between the follower (599) in the folded position and the second transmission member (251) along the longitudinal axis of the pole (111) being smaller than a second spacing between the follower (599) in the unfolded position and the second transmission member (251) along the longitudinal axis of the pole (111), with the second spacing being smaller than a third spacing between the follower (599) in the tilted position and the second transmission member (251) along the longitudinal axis of the pole (111), wherein when the follower (599) moves from the unfolded position to the tilted position through rotation of the helical spring (579), the follower (599) pushes the connection member (405) to move along the longitudinal axis of the pole (111), causing compression of the spring (421) by the positioning pin (415), the connection member (405) actuates the link (471) to move the actuation rod (403) along the sliding groove (375) of the fixing member (363), the actuation rod (403) presses against a wall of the track (395) of the pivotable member (383) to pivot the pivotable member (383) from the first position to the second position, the hub (439), the plurality of ribs (451), and the plurality of stretchers (313) pivot together with the pivotable member (383), the hub (439) and the plurality of ribs (451) are tilted relative to the pole (111), wherein when the follower (599) is in the unfolded position or the tilted position, if the canopy (475), the plurality of ribs (475), or the plurality of stretchers (451) is subjected to the external force causing the pivotal member (383) to pivot from the first position towards the second position, the helical spring (579) is compressed by the follower (599) and undergoes elastic deformation to provide a buffering effect to the external force, and wherein when the follower (599) moves from the tilted position to the unfolded position through rotation of the helical spring (579), the spring (421) presses against the positioning pin (415) to cause the connection member (405) and the link (471) to move jointly along the longitudinal axis of the pole (111), the actuation rod (403) presses against the wall of the track (395) of the pivotable member (383) to pivot the pivotable member (383) from the second position to the first position, the hub (439) and the plurality of ribs (451) are not tilted relative to the pole (111) when the pivotable member (383) is in the first position.

4. The tiltable sunshade as claimed in claim 3, further comprising: a connecting member (257) mounted between the rod (573) and the second transmission member (251), with the connecting member (257) including a first end (259) and a second end (273), with a first receptacle (271) defined in an end face of the first end (259) of the connecting member (257), with a second receptacle (275) defined in an end face of the second end (273) of the connecting member (257), with the lower end (575) of the rod (573) fixed in the second receptacle (275), with the shaft (255) fixed in the first receptacle (271), with the second transmission member (251), the connecting member (257), and the helical spring (579) not movable along the longitudinal axis of the pole (111).

5. The tiltable sunshade as claimed in claim 2, with the pitch of the large pitch portion (595) of the helical spring (579) being between 7 mm and 12 mm, and with the pitch of the small pitch portion (597) of the helical spring (579) being between 2 mm and 4 mm.

* * * * *